US009014855B2

(12) United States Patent
Teng et al.

(10) Patent No.: US 9,014,855 B2
(45) Date of Patent: Apr. 21, 2015

(54) CONTROL METHOD FOR CLEANING ROBOTS

(71) Applicant: Micro-Star International Company Limited, New Taipei (TW)

(72) Inventors: You-Wei Teng, New Taipei (TW); Shih-Che Hung, Hsinchu (TW); Yao-Shih Leng, Taipei (TW)

(73) Assignee: MSI Computer (Shenzhen) Co., Ltd., Shenzhen (CN)

( * ) Notice: Subject to any disclaimer, the term of this patent is extended or adjusted under 35 U.S.C. 154(b) by 108 days.

(21) Appl. No.: 13/768,531

(22) Filed: Feb. 15, 2013

(65) Prior Publication Data

US 2013/0218343 A1 Aug. 22, 2013

Related U.S. Application Data

(60) Provisional application No. 61/599,690, filed on Feb. 16, 2012.

(30) Foreign Application Priority Data

Oct. 1, 2012 (TW) ..... 101136167 A

(51) Int. Cl.
*G05B 15/00* (2006.01)
*G05B 19/00* (2006.01)
*A47L 11/40* (2006.01)

(52) U.S. Cl.
CPC ..... *A47L 11/4011* (2013.01); *A47L 2201/00* (2013.01); *A47L 2201/04* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,124,694 | A * | 9/2000 | Bancroft et al. | 318/587 |
| 6,671,592 | B1 * | 12/2003 | Bisset et al. | 701/23 |
| 6,690,134 | B1 * | 2/2004 | Jones et al. | 318/567 |
| 6,781,338 | B2 * | 8/2004 | Jones et al. | 318/567 |
| 6,965,209 | B2 * | 11/2005 | Jones et al. | 318/567 |
| 7,196,487 | B2 * | 3/2007 | Jones et al. | 318/567 |
| 7,567,052 | B2 * | 7/2009 | Jones et al. | 318/587 |
| 7,579,803 | B2 * | 8/2009 | Jones et al. | 318/567 |
| 7,706,917 | B1 * | 4/2010 | Chiappetta et al. | 700/245 |
| 8,368,339 | B2 * | 2/2013 | Jones et al. | 318/567 |
| 8,380,350 | B2 * | 2/2013 | Ozick et al. | 700/253 |
| 8,659,255 | B2 * | 2/2014 | Jones et al. | 318/567 |
| 8,659,256 | B2 * | 2/2014 | Jones et al. | 318/567 |
| 8,742,926 | B2 * | 6/2014 | Schnittman et al. | 340/540 |
| 2008/0051953 | A1 * | 2/2008 | Jones et al. | 701/28 |
| 2008/0191653 | A1 * | 8/2008 | Han et al. | 318/568.12 |
| 2009/0319083 | A1 * | 12/2009 | Jones et al. | 700/259 |
| 2013/0218341 | A1 * | 8/2013 | Teng et al. | 700/259 |

* cited by examiner

*Primary Examiner* — Bhavesh V Amin
(74) *Attorney, Agent, or Firm* — Birch, Stewart, Kolasch & Birch, LLP

(57) ABSTRACT

An embodiment of the invention provides a control method for a cleaning robot with a quasi-omnidirectional detector and a directional light detector. The method includes: rotating the non-omnidirectional light detector when the non-omnidirectional light detector detects a light beam; when the non-omnidirectional light detector does not detect the light beam, the non-omnidirectional light detector is stopped from being spun and a rotation angle is estimated; determining a rotation direction according to the rotation angle; rotating the cleaning robot according to the rotation direction; stopping the rotation of the cleaning robot when the directional light detector detects the light beam.

18 Claims, 13 Drawing Sheets

CONTROL METHOD FOR CLEANING ROBOTS

CROSS REFERENCE TO RELATED APPLICATIONS

This Application claims the benefit of U.S. Provisional Application No. 61/599,690 filed Feb. 16, 2012, the entirety of which is incorporated by reference herein.

This Application claims priority of Taiwan Patent Application No. 101136167, filed on Oct. 1, 2012, the entirety of which is incorporated by reference herein.

BACKGROUND OF THE INVENTION

1. Field of the Invention

The invention relates to a cleaning robot, and more particularly, to a cleaning robot with a non-omnidirectional light detector.

2. Description of the Related Art

A variety of movable robots, which generally include a driving means, a sensor and a travel controller, and perform many useful functions while autonomously operating, have been developed. For example, a cleaning robot for the home, is a cleaning device that sucks dust and dirt from the floor of a room while autonomously moving around the room without user manipulation.

BRIEF SUMMARY OF THE INVENTION

An embodiment of the invention provides a control method of a cleaning robot with a quasi-omnidirectional light detector and a directional light detector. The method comprises the steps of: spinning the quasi-omnidirectional light detector when the quasi-omnidirectional light detector detects a light beam; stopping the spinning of the quasi-omnidirectional light detector and estimating a spin angle when the quasi-omnidirectional does not detect the light beam; determining a spin direction according to the spin angle; spinning the cleaning robot according to the spin direction; and stopping the spinning of the cleaning robot when the directional light detector detects the light beam.

Another embodiment of the invention provides a control method of a cleaning robot with a quasi-omnidirectional light detector and a directional light detector. The method comprises the steps of: detecting a light beam via the quasi-omnidirectional light detector; continuing the movement of the cleaning robot when the quasi-omnidirectional light detector detects a light beam for a first time; stopping the spinning of the quasi-omnidirectional light detector and estimating a spin angle when the quasi-omnidirectional light detector does not detect the light beam; determining a spin direction according to the spin angle; spinning the cleaning robot according to the spin direction; stopping the spinning of the cleaning robot when the directional light detector detects the light beam.

Another embodiment of the invention provides a cleaning robot. The cleaning robot comprises a non-omni directional light detector and a directional light detector for detecting a wireless signal. When the non-omni directional light detector detects the wireless signal, a spin direction is determined via the non-omni directional light detector according to the detection result of the non-omni directional light detector. Then the cleaning robot is spun according to the spin direction and the cleaning robot stops spinning when the directional light detector detects the wireless signal.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
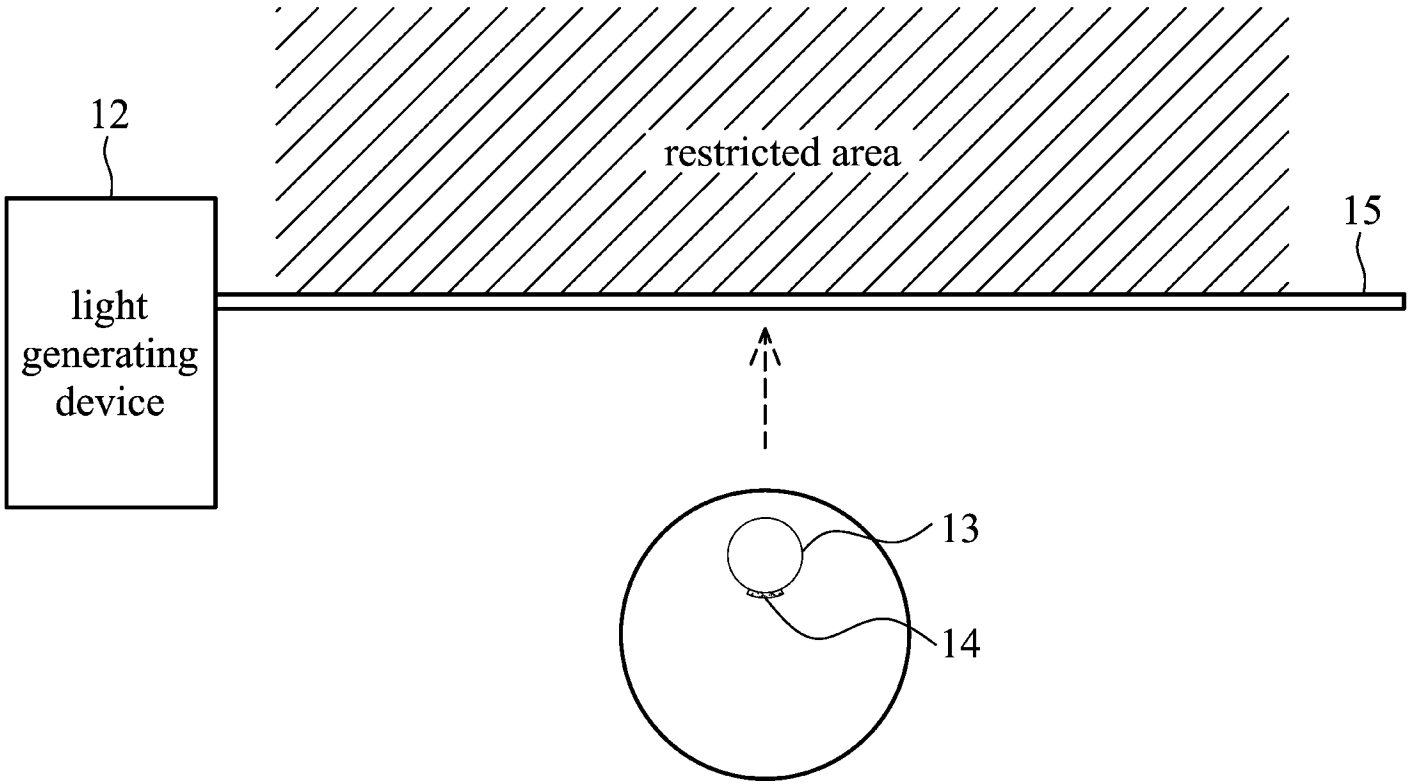
FIG. 1 is a schematic diagram of a light generating device and a cleaning robot according to an embodiment of the invention.

FIG. 1 is a schematic diagram of a light generating device and a cleaning robot according to an embodiment of the invention. The light generating device 12 outputs a light beam 15 to label a restricted area that the cleaning robot 11 should not enter. The cleaning robot 11 comprises a non-omnidirectional light detector 13 having a rib (or called mask) 14, where the rib 14 produces a shadowed area on the non-omnidirectional light detector 13 by a predetermined angle and the range of the predetermined angle is from 30 degrees to 90 degrees.

The rib 14 may be fixed on the surface of the non-omnidirectional light detector 13 or movable along the non-omnidirectional light detector 13. The rib 14 can be spun in 360 degrees along the surface of the non-omnidirectional light detector 13. In this embodiment, the term, non-omni, is a functional description to describe that the rib 14 causes an area on the surface of the non-omnidirectional light detector 13 and the non-omnidirectional light detector 13 cannot not detect light therein or light to not directly reach that area.

Thus, the non-omnidirectional light detector 13 can be implemented in two ways. The first implementation is to combine an omni-light detector with a rib 14 and the rib 14 is fixed on a specific position of the surface of the omni-light detector. The non-omnidirectional light detector 13 is disposed on a plate that can be spun by a motor. Thus, the purpose of spinning of the non-omnidirectional light detector 13 can be achieved. When the non-omnidirectional light detector 13 detects the light beam, an incident angle of the light beam 15 can be determined by spinning the non-omnidirectional light detector 13.

Another implementation of the non-omnidirectional light detector 13 is implemented by telescoping a mask kit on an omni-light detector, wherein the omni light detector cannot be spun and the masking kit is movable along a predetermined track around the omni light detector. The mask kit is spun by a motor. When the non-omnidirectional light detector 13 detects the light beam 15, the mask kit is spun to determine the incident angle of the light beam 15.

Reference can be made to FIGS. 2*a* to 2*e* for the detailed description of the non-omnidirectional light detector 13.

Figure 2A:
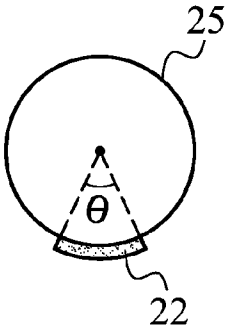
FIG. 2*a* is a top view of an embodiment of a non-omnidirectional light detector according to the invention.

FIG. 2*a* is a top view of an embodiment of a non-omnidirectional light detector according to the invention. The mask 22 is formed by an opaque material and is adhered to a part of sensing area of an omni light detector 21. The mask 22 forms a sensing dead zone with an angle θ on the omni light detector 21.

Figure 2B:
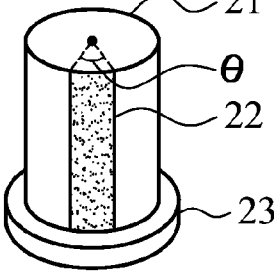
FIG. 2*b* is a flat view of the non-omnidirectional light detector of FIG. 2*a*.

Please refer to FIG. 2*b*. FIG. 2*b* is a flat view of the non-omnidirectional light detector of FIG. 2*a*. In FIG. 2*b*, the omni light detector 21 is fixed on a base 23. The base 23 can be driven and spun by a motor or a step motor. A controller of the cleaning robot outputs a control signal to spin the base 23. Although the typical type of omni light detector 21 can receive light from any direction, the omni light detector 21 cannot determined the direction that the light comes from and the cleaning robot cannot know the position of a light generating device or charging station. With the help of the mask 22, the light direction can be determined.

When the omni light detector 21 detects a light beam, the base 23 is set to be spun for 360 degrees in a clockwise direction or a counter clockwise direction. When the omni light detector 21 cannot detect the light beam, a controller of the cleaning robot calculates a spin angle of the base 23, wherein the spin angle ranges from 0 degree to (360−θ) degrees. The controller then determines the direction of the light beam according to a spin direction of the base 23, the spin angle and the angle θ. Reference can be made to the descriptions related to FIG. 2*c* and FIG. 2*d* a more detailed description for estimating an incident angle of a light beam.

Figure 2D:
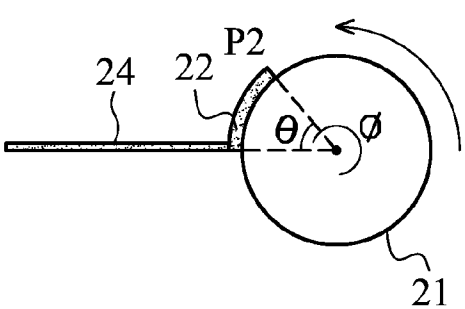
FIGS. 2*c* and 2*d* are schematic diagrams for estimating an incident angle of a light beam by using the proposed non-omnidirectional light detector according to the invention.
Figure 2E:
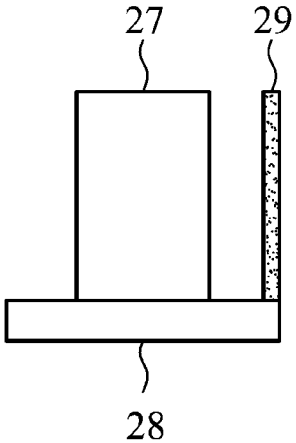
FIG. 2*e* is a schematic diagram of another embodiment of a non-omnidirectional light detector according to the invention.
Figure 2C:
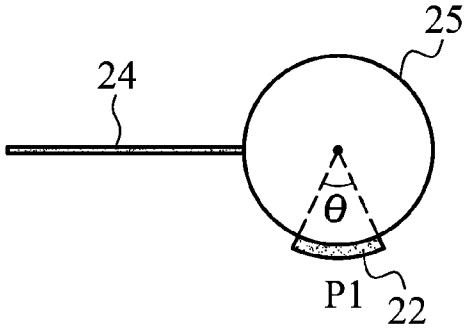

FIGS. 2*c* and 2*d* are schematic diagrams for estimating an incident angle of a light beam by using the proposed non-omnidirectional light detector according to the invention. In FIG. 2*c*, the initial position of the mask 22 is at P1. When the non-omnidirectional light detector 25 detects a light beam 24, the non-omnidirectional light detector 25 is spun in a predetermined direction. In this embodiment, the predetermined direction is a counter clockwise direction. In FIG. 2*d*, when the non-omnidirectional light detector 25 does not detect the light beam 24, the non-omnidirectional light detector 25 stops spinning. The controller of the cleaning robot determines a spin angle Φ of the non-omnidirectional light detector 25 and estimates the direction of the light beam 24 according to the spin angle Φ and the initial position P1.

In another embodiment, the non-omnidirectional light detector 25 is driven by a motor, and the motor transmits a spin signal to the controller for estimating the spin angle Φ. In another embodiment, the non-omnidirectional light detector 25 is driven by a step motor. The step motor is spun according to numbers of received impulse signals. The controller therefore estimates the spin angle Φ according to the number of impulse signals and a step angle of the step motor.

In another embodiment, the non-omnidirectional light detector 25 is fixed on a base device with a gear disposed under the base device, wherein meshes of the gear are driven by the motor. In another embodiment, the non-omnidirectional light detector 25 is driven by the motor via a timing belt.

FIG. 2*e* is a schematic diagram of another embodiment of a non-omnidirectional light detector according to the invention. The non-omnidirectional light detector 26 comprises an omni light detector 27, a base 28 and a vertical extension part 29 formed on the base 28. The vertical extension part 29 is formed by an opaque material and forms a dead zone area on the surface of the omni light detector 27. When the light beam is toward to the dead zone area, the omni light detector 27 cannot detect the light beam. The base 28 is spun by a motor to detect a light direction. The omni light detector 27 is not physically connected to the base 28 and the omni light detector 27 is not spun when the base is spun by the motor. Reference can be made to the descriptions related to FIGS. 2*c* and 2*d* for the light direction detection operation of the non-omnidirectional light detector 26.

Figure 3:
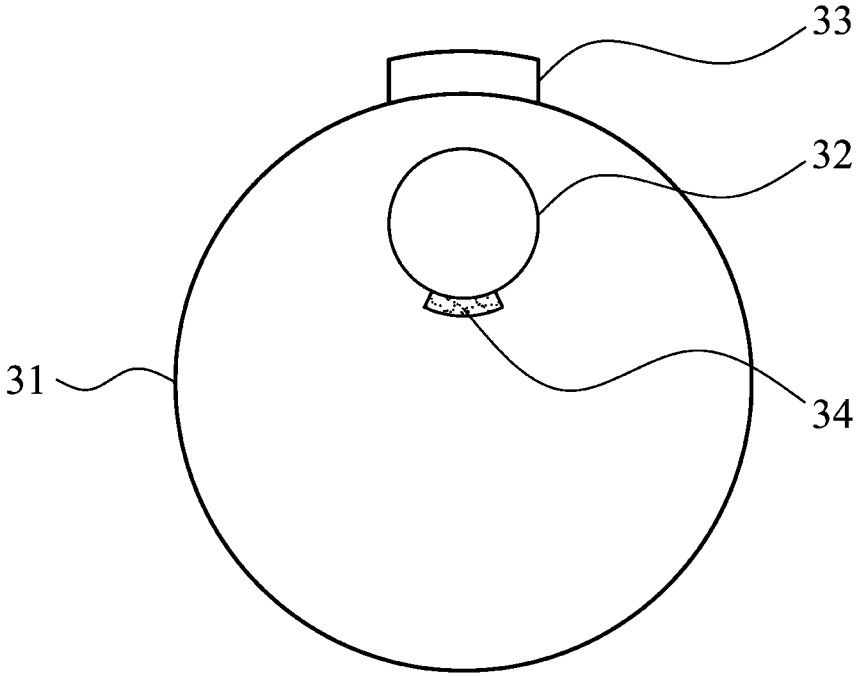
FIG. 3 is a schematic diagram of an embodiment of a cleaning robot according to the invention.

FIG. 3 is a schematic diagram of an embodiment of a cleaning robot according to the invention. The cleaning robot 31 comprises a quasi-omnidirectional light detector 32, a directional light detector 33 and a mask 34. In FIG. 3, only the elements related to the invention are discussed, but the invention is not limited thereto. The cleaning robot 31 still may comprise other hardware devices, firmware or software for controlling the hardware, which are not discussed for brevity.

When the quasi-omnidirectional light detector 32 detects a light beam, a controller of the quasi-omnidirectional light detector 32 or a processor of the cleaning robot 31 first determines the strength of the detected light beam. If the strength of the received signal is less than a predetermined value, the controller or the processor does not respond thereto or take any action. When the strength of the received signal is larger than or equal to the predetermined value, the controller or the processor determines whether the light beam was output by a light generating device.

When the light beam is output by the light generating device, the quasi-omnidirectional light detector 32 is spun to determine the direction of the light beam or an included angle between the light beam and the current moving direction of the cleaning robot 31. When the direction of the light beam or the included angle is determined, the processor of the cleaning robot 31 determines a spin direction, such as a clockwise direction or counter clockwise direction. The cleaning robot 31 is spun in a circle at the same position. When the directional light detector 33 detects the light beam, the cleaning robot 31 stops spinning.

In another embodiment, when the quasi-omnidirectional light detector 32 detects the light beam and the light beam is output from the light generating device, the quasi-omnidirectional light detector 32 and the cleaning robot 31 are spun in the clockwise direction or the counter clockwise direction simultaneously. When the directional light detector 33 detects the light beam, the cleaning robot 31 stops spinning.

In other words, the processor of the cleaning robot 31 controls the cleaning robot 31 to spin in the clockwise direction or the counter clockwise direction according to the detection result of the quasi-omnidirectional light detector 32. When the directional light detector 33 detects the light beam output by the light generating device, the cleaning robot 31 stops spinning, and the processor of the cleaning robot 31 controls the cleaning robot 31 to move to the light generating device straightforwardly.

In another embodiment, the processor controls the cleaning robot 31 according to the detection results of the directional light detector 33 and the quasi-omnidirectional light detector 32 to do some operations, such as a moving operation, or cleaning operation or interaction between the cleaning robot 31 and the light generating device. For example, when the light beam is output by the light generating device, the controller of the cleaning robot 31 controls the cleaning robot 31 to move to the light generating device and execute the cleaning operation. When the light beam is output by the charging station, the processor of the cleaning robot 31 determines whether the cleaning robot 31 has to be charged. When the cleaning robot 31 needs to be charged, the processor controls the cleaning robot 31 to enter the charging station for charging and execute the cleaning operation during the movement to the charging station.

In another embodiment, the light beam detected by the cleaning robot 31 contains information or control signals. The processor of the cleaning robot 31 decodes the light beam to acquire the information or the control signals. For example, the charging station can connect to a portable device of a user via wireless network and the user can control the cleaning robot 31 via the portable device. The portable device may be a remote controller of the cleaning robot 31 or a smart phone.

Before approaching to the light generating device, the cleaning robot 31 moves along the light beam output by the light generating device and cleans the area near the light beam. The processor of the cleaning robot 31 continuously monitors the directional light detector 33 to determine whether the directional light detector 33 receives the light beam output by the light generating device. Once the directional light detector 33 fails to detect the light beam, the cleaning robot 31 is spun to calibrate the moving direction of the cleaning robot 31.

In one embodiment, the directional light detector 33 comprises a plurality of light detection units and the processor slightly calibrates the moving direction of the cleaning robot 31 according to the detection results of the light detection units.

Figure 4:
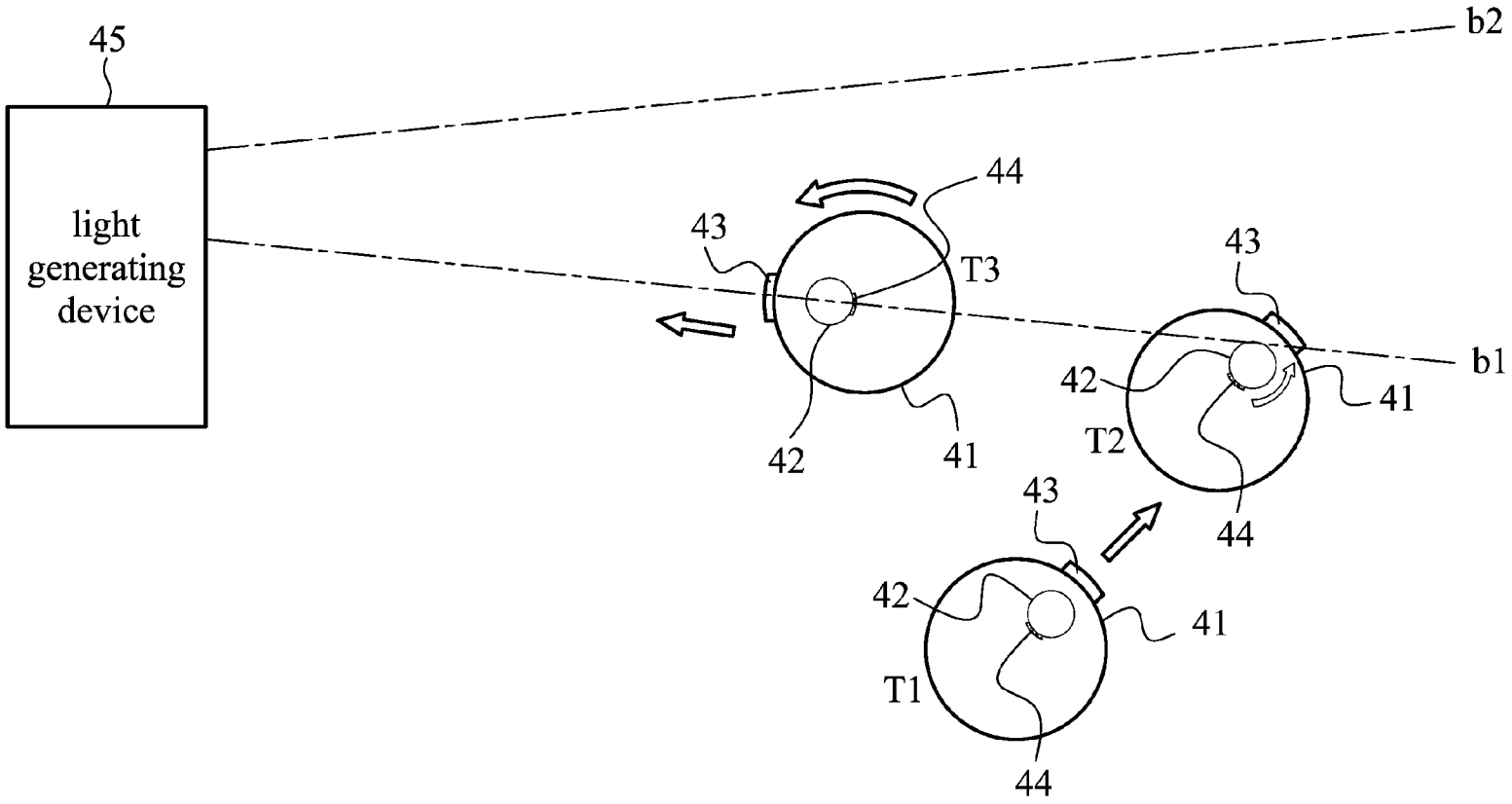
FIG. 4 is a schematic diagram of a control method for a cleaning robot according to another embodiment of the invention.

FIG. 4 is a schematic diagram of a control method for a cleaning robot according to another embodiment of the invention. The light generating device 45 outputs a light beam to label a restricted area that the cleaning robot 41 should not enter. In other embodiments, the light generating device 41 is named as light house or light tower and outputs the light beam or other wireless signals. The light beam comprises a first boundary b1 and a second boundary b2. At time T1, the cleaning robot 41 moves along a predetermined route. At time T2, the quasi-omnidirectional light detector 42 detects a first boundary b2 of a light beam emitted by the light generating device 45. The cleaning robot 41 stops moving, and the quasi-omnidirectional light detector 42 is spun in a counter clockwise direction or a clockwise direction.

When the mask 44 blocks the light beam emitted from the light generating device 45, the quasi-omnidirectional light detector 42 cannot detect the light beam. A controller of the cleaning robot 41 records a current position of the mask 44 and estimates a first spin angle of the quasi-omnidirectional light detector 42 according to an initial position of the mask 44 and the current position of the mask 44 to determine a spin direction of the cleaning robot 41.

For example, assuming the first spin angle is less than 180 degrees, the cleaning robot 41 is spun in the clockwise direction. The cleaning robot 41 is spun in the counter clockwise direction when the first spin angle is larger than 180 degrees.

At time T3, the cleaning robot 41 is spun according to the determined direction until the directional light detector 43 detects the light beam output by the light generating device 45. When the directional light detector 43 detects the light beam output by the light generating device 45, the cleaning robot 41 stops spinning. Generally speaking, when the directional light detector detects the light beam output by the light generating device 45, the light detection units detecting the light beam are located at the margin of the directional light detector 43. Thus, when the cleaning robot 41 moves again, the directional light detector 43 may fail to detect the light beam quickly and the cleaning robot 41 has to stop again to calibrate the moving direction.

To solve the aforementioned issue, in one embodiment, the processor of the cleaning robot 41 estimates a delay time according to the angular velocity of the cleaning robot 41 and the size of the directional light detector 43. When the directional light detector 43 detects the light beam, the cleaning robot 41 stops spinning after the delay time. By the delay time, the light beam output by the light generating device 45 can be detected by the center of the directional light detector 43.

It is noted that the cleaning robot 41 stays at the same position at times T2 and T3. At time T2, the cleaning robot 41 is not moved or spun and only the quasi-omnidirectional light detector 42 is spun. At time T3, the cleaning robot 41 is spun in a circle at the original position. Although the position of the cleaning robot 41 at time T2 is different from the position of the cleaning robot 41 at time T3 in FIG. 4, it represents only two operations at the same position but at different times. In fact, the position of the cleaning robot 41 does not change at time T2 and T3.

In another embodiment, the operations of the cleaning robot 41 at time T2 and T3 can be integrated in one step. At time T2, the quasi-omnidirectional light detector 42 is spun in a predetermined direction, and the cleaning robot is also spun in the predetermined direction. When the directional light detector 43 detects the light beam output by the light generating device 45, the cleaning robot 41 stops spinning. When the cleaning robot 41 stops spinning, the quasi-omnidirectional light detector 42 may be stopped or continues to spin. If the quasi-omnidirectional light detector 42 is still spinning the processor of the cleaning robot 41 determines the direction of the light beam to calibrate the moving direction of the cleaning robot 41 according to the spin angle of the quasi-omnidirectional light detector 42.

When the cleaning robot 41 moves to the light generating device 45, the processor of the cleaning robot 41 records the moving paths of the cleaning robot 41 and labels the moving path and a restricted area on a map. In another embodiment, when the processor of the cleaning robot 41 determines the direction of the light beam output by the light generating device, the processor labels the light beam and the restricted area on the map. The map is stored in a memory or a map database of the cleaning robot 41. The processor modifies the map according to the movement of the cleaning robot 41 and labels the positions of obstacles on the map.

When the cleaning robot 41 approaches to the light generating device 45 and the distance between the cleaning robot 41 and the light generating device 45 is less than a predetermined distance, a touch sensor or an acoustic sensor outputs a stop signal to the controller of the cleaning robot 41. The touch sensor or the acoustic sensor is disposed in the front end of the cleaning robot 41 to detect whether there is any obstacle in front of the cleaning robot 41. When the touch sensor or the acoustic sensor detects an obstacle, the cleaning robot 41 first determines whether the obstacle is the light generating device 45. If the obstacle is the light generating device 45, the cleaning robot 41 stops moving and moves in another direction. If the obstacle is not the light generating device 45, the cleaning robot 41 first leaves the original route to avoid the obstacle and returns to the original route after avoiding the obstacle.

When the cleaning robot 41 approaches to the light generating device 45, the light generating device 45 outputs a radio frequency (RF) signal or an infrared signal to let the cleaning robot 41 know that the cleaning robot 41 is close to the light generating device 45. In another embodiment, Near Field Communication (NFC) devices are embedded in both the cleaning robot 41 and the light generating device 45. When the NFC device of the cleaning robot 41 receives signals or data from the NFC device of the light generating device 45, it means that the cleaning robot 41 is close to the light generating device 45 and the cleaning robot 41 should stop accordingly. Generally speaking, the sensing distance of the NFC device is 20 cm.

According to the above description, the cleaning robot 41 can clean the areas near the light beam output by the light generating device 45 and the cleaning robot 41 will not enter a restricted area. Furthermore, the controller of the cleaning robot 41 can draw a map of the cleaning area. When the cleaning robot 1 cleans the same area again, the cleaning robot 41 can move according to the map of the cleaning area to complete the cleaning job efficiently and quickly.

Although the embodiment of FIG. 4 is illustrated with the light generating device 45, the invention is not limited thereto. The method of FIG. 4 can be applied to the charging station. The charging station outputs a guiding signal, such as a light beam, to direct the cleaning robot 41 to enter the charging station for charging.

Furthermore, the embodiment of FIG. 4 is illustrated with the quasi-omnidirectional light detector 42 but the invention is not limited thereto. The quasi-omnidirectional light detector 42 can be replaced by an acoustic signal detector or other kinds of signal detector.

Figure 5:
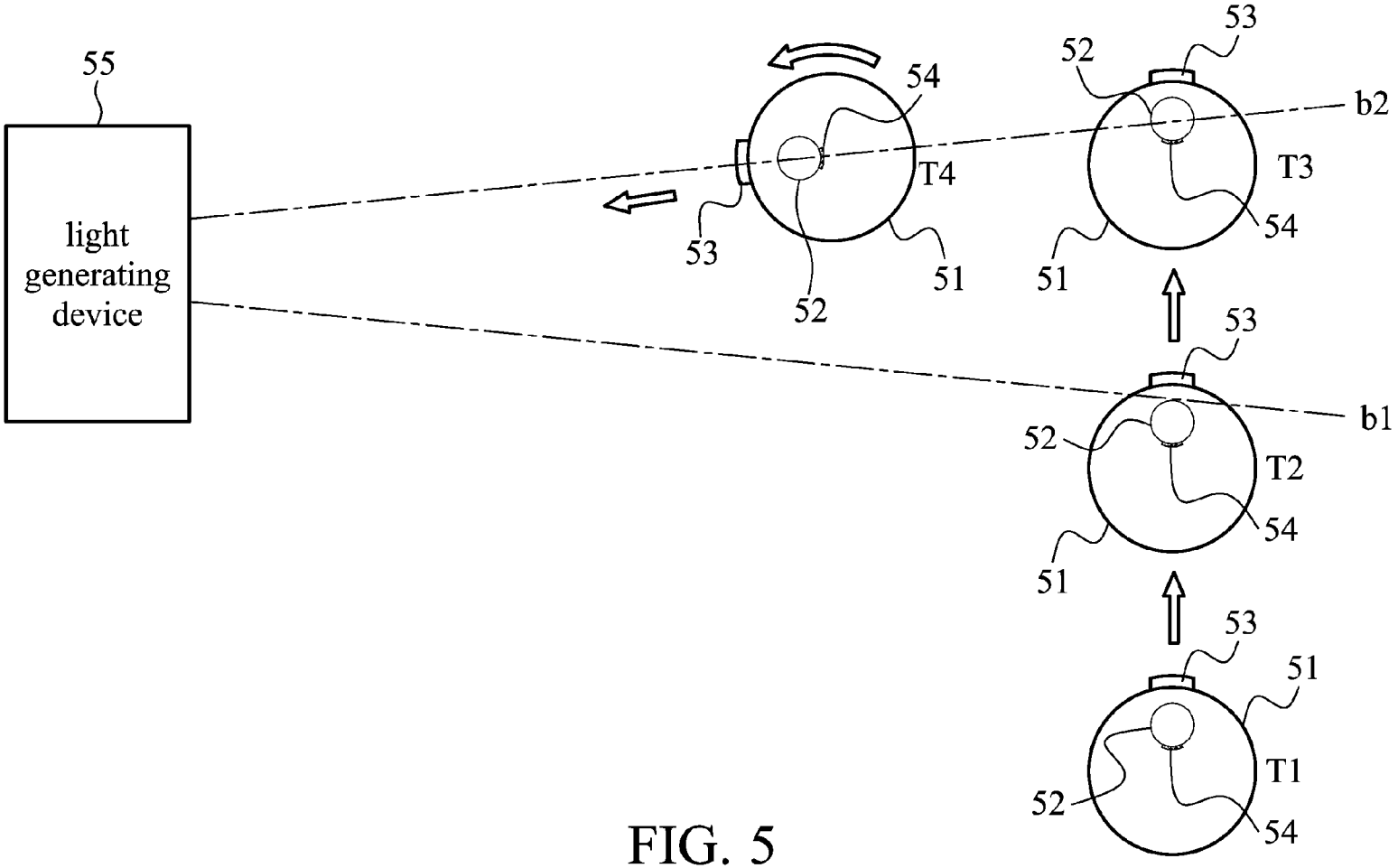
FIG. 5 is a schematic diagram of a control method for a cleaning robot according to another embodiment of the invention.

FIG. 5 is a schematic diagram of a control method for a cleaning robot according to another embodiment of the invention. The light generating device 55 outputs a light beam to label a restricted area that the cleaning robot 51 should not enter. In other embodiments, the light generating device 51 is named as light house or light tower and outputs the light beam or other wireless signals. The light beam comprises a first boundary b1 and a second boundary b2. At time T1, the cleaning robot 51 moves along a predetermined route. At time T2, the quasi-omnidirectional light detector 52 detects a first boundary b2 of a light beam emitted by the light generating device 55. The cleaning robot 51 keeps moving along the predetermined route. At time T3, the quasi-omnidirectional light detector 52 detects the light beam and the cleaning robot 51 stops moving. The quasi-omnidirectional light detector 52 is then spun in a counter clockwise direction or a clockwise direction.

When the mask 54 blocks the light beam emitted from the light generating device 54, the quasi-omnidirectional light detector 52 cannot detect the light beam. A controller of the cleaning robot 51 records a current position of the mask 54 and estimates a first spin angle of the quasi-omnidirectional light detector 52 according to an initial position of the mask 54 and the current position of the mask 54 to determine a spin direction of the cleaning robot 51.

For example, assuming the first spin angle is less than 180 degrees, the cleaning robot 51 is spun in the clockwise direction. The cleaning robot 51 is spun in the counter clockwise direction when the first spin angle is larger than 180 degrees.

At time T4, the cleaning robot 51 is spun according to the determined direction until the directional light detector 53 detects the light beam output by the light generating device 55. When the directional light detector 53 detects the light beam output by the light generating device 55, the cleaning robot 51 stops spinning. Generally speaking, when the directional light detector detects the light beam output by the light generating device 55, the light detection units detecting the light beam are located at the margin of the directional light detector 53. Thus, when the cleaning robot 51 moves again, the directional light detector 53 may fail to detect the light beam quickly and the cleaning robot 51 has to stop again to calibrate the moving direction.

To solve the aforementioned issue, in one embodiment, the processor of the cleaning robot 51 estimates a delay time according to the angular velocity of the cleaning robot 51 and the size of the directional light detector 53. When the directional light detector 53 detects the light beam, the cleaning robot 51 stops spinning after the delay time. By the delay time, the light beam output by the light generating device 55 can be detected by the center of the directional light detector 53.

It is noted that the cleaning robot 51 stays at the same position at times T3 and T4. At time T3, the cleaning robot 51 is not moved or spun and only the quasi-omnidirectional light detector 52 is spun. At time T4, the cleaning robot 51 is spun in a circle at the original position. Although the position of the cleaning robot 51 at time T3 is different from the position of the cleaning robot 51 at time T4 in FIG. 4, it represents only two operations at the same position but at different times. In fact, the position of the cleaning robot 51 does not change at time T3 and T4.

In another embodiment, the operations of the cleaning robot 51 at time T3 and T4 can be integrated in one step. At time T3, the quasi-omnidirectional light detector 52 is spun in a predetermined direction, and the cleaning robot is also spun in the predetermined direction. When the directional light detector 53 detects the light beam output by the light generating device 55, the cleaning robot 51 stops spinning. When the cleaning robot 51 stops spinning, the quasi-omnidirectional light detector 52 may be stopped or continues to spin. If the quasi-omnidirectional light detector 52 is still spinning the processor of the cleaning robot 51 determines the direction of the light beam to calibrate the moving direction of the cleaning robot 41 according to the spin angle of the quasi-omnidirectional light detector 52.

When the cleaning robot 51 moves to the light generating device 55, the processor of the cleaning robot 51 records the moving paths of the cleaning robot 51 and labels the moving path and a restricted area on a map. In another embodiment, when the processor of the cleaning robot 51 determines the direction of the light beam output by the light generating device, the processor labels the light beam and the restricted area on the map. The map is stored in a memory or a map database of the cleaning robot 51. The processor modifies the map according to the movement of the cleaning robot 51 and labels the positions of obstacles on the map.

When the cleaning robot 51 approaches to the light generating device 55 and the distance between the cleaning robot 51 and the light generating device 55 is less than a predetermined distance, a touch sensor or an acoustic sensor outputs a stop signal to the controller of the cleaning robot 51. The touch sensor or the acoustic sensor is disposed in the front end of the cleaning robot 51 to detect whether there is any obstacle in front of the cleaning robot 51. When the touch sensor or the acoustic sensor detects an obstacle, the cleaning robot 51 first determines whether the obstacle is the light generating device 55. If the obstacle is the light generating device 55, the cleaning robot 51 stops moving and moves in another direction. If the obstacle is not the light generating device 55, the cleaning robot 51 first leaves the original route to avoid the obstacle and returns to the original route after avoiding the obstacle.

When the cleaning robot 51 approaches to the light generating device 55, the light generating device 55 outputs a radio frequency (RF) signal or an infrared signal to inform the cleaning robot 51 know that the cleaning robot 51 is close to the light generating device 55. In another embodiment, Near Field Communication (NFC) devices are embedded in both the cleaning robot 51 and the light generating device 55. When the NFC device of the cleaning robot 51 receives signals or data from the NFC device of the light generating device 55, it means that the cleaning robot 51 is close to the light generating device 55 and the cleaning robot 51 should stop accordingly. Generally speaking, the sensing distance of the NFC device is 20 cm.

Figure 6:
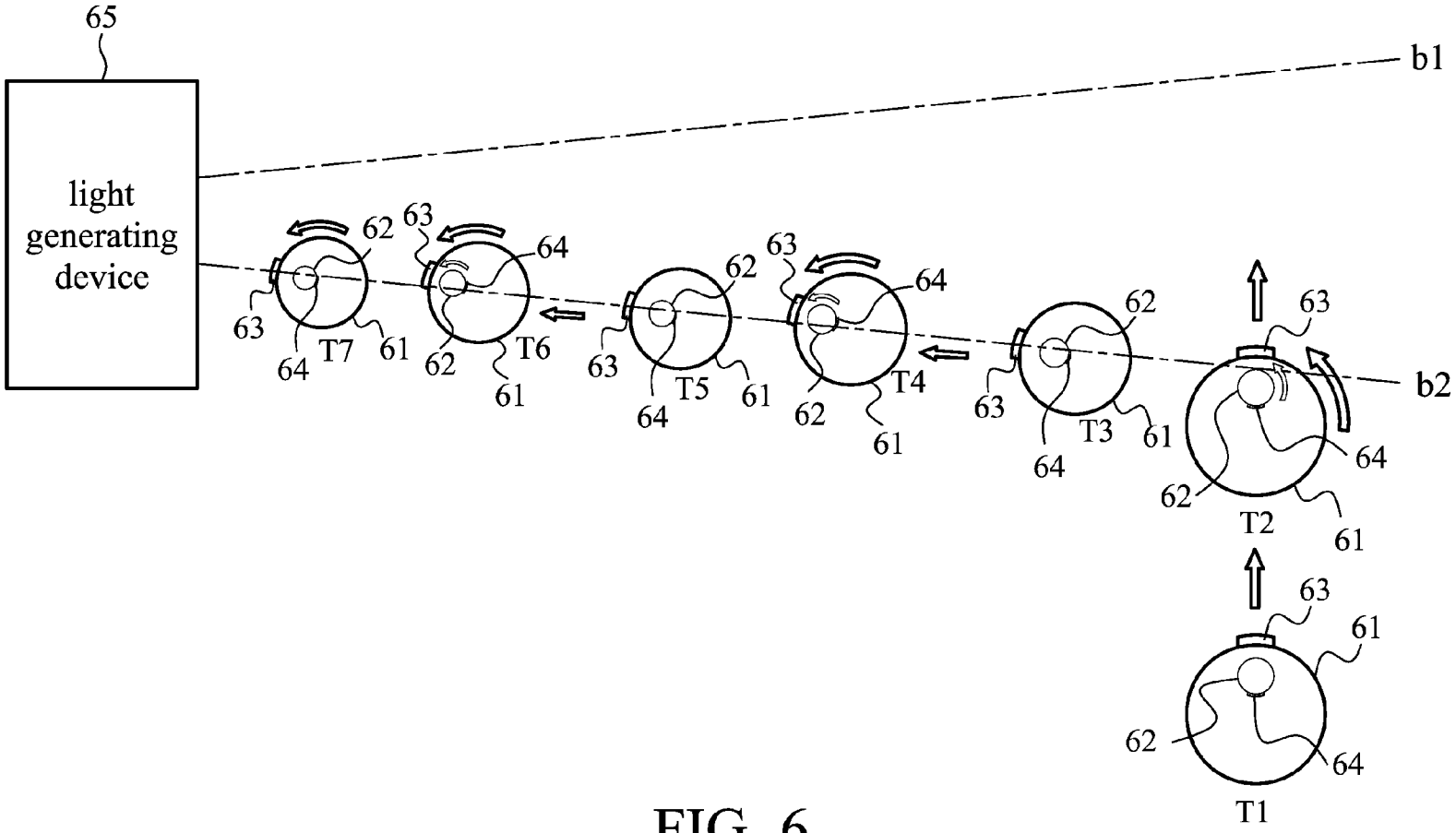
FIG. 6 is a schematic diagram of a control method for a cleaning robot according to another embodiment of the invention.

FIG. 6 is a schematic diagram of a control method for a cleaning robot according to another embodiment of the invention. The light generating device 65 outputs a light beam to label a restricted area that the cleaning robot 61 should not enter. In other embodiments, the light generating device 61 is named as light house or light tower and outputs the light beam or other wireless signals. The light beam comprises a first boundary b1 and a second boundary b2. At time T1, the cleaning robot 61 moves along a predetermined route. At time T2, the quasi-omnidirectional light detector 62 detects a first boundary b2 of a light beam emitted by the light generating device 65. The cleaning robot 61 stops moving, and the quasi-omnidirectional light detector 62 is spun in a counter clockwise direction or a clockwise direction.

When the mask 64 blocks the light beam emitted from the light generating device 65, the quasi-omnidirectional light detector 62 cannot detect the light beam. A controller of the cleaning robot 61 records a current position of the mask 64 and estimates a first spin angle of the quasi-omnidirectional light detector 62 according to an initial position of the mask 64 and the current position of the mask 64 to determine a spin direction of the cleaning robot 61.

For example, assuming the first spin angle is less than 180 degrees, the cleaning robot 61 is spun in the clockwise direction. The cleaning robot 61 is spun in the counter clockwise direction when the first spin angle is larger than 180 degrees.

At time T3, the cleaning robot 61 is spun according to the determined direction until the directional light detector 63 detects the light beam output by the light generating device 65. When the directional light detector 63 detects the light beam output by the light generating device 65, the cleaning robot 61 stops spinning. Generally speaking, when the directional light detector detects the light beam output by the light generating device 65, the light detection units detecting the light beam are located at the margin of the directional light detector 63. Thus, when the cleaning robot 61 moves again, the directional light detector 63 may fail to detect the light beam quickly and the cleaning robot 61 has to stop again to calibrate the moving direction.

To solve the aforementioned issue, in one embodiment, the processor of the cleaning robot 61 estimates a delay time according to the angular velocity of the cleaning robot 61 and the size of the directional light detector 63. When the directional light detector 63 detects the light beam, the cleaning robot 61 stops spinning after the delay time. By the delay time, the light beam output by the light generating device 65 can be detected by the center of the directional light detector 63.

It is noted that the cleaning robot 61 stays at the same position at times T2 and T3. At time T2, the cleaning robot 61 is not moved or spun and only the quasi-omnidirectional light detector 62 is spun. At time T3, the cleaning robot 61 is spun in a circle at the original position. Although the position of the cleaning robot 61 at time T2 is different from the position of the cleaning robot 61 at time T3 in FIG. 6, it represents only two operations at the same position but at different times. In fact, the position of the cleaning robot 61 does not change at time T2 and T3.

In another embodiment, the operations of the cleaning robot 61 at time T2 and T3 can be integrated in one step. At time T2, the quasi-omnidirectional light detector 62 is spun in a predetermined direction, and the cleaning robot is also spun in the predetermined direction. When the directional light detector 63 detects the light beam output by the light generating device 65, the cleaning robot 61 stops spinning. When the cleaning robot 61 stops spinning, the quasi-omnidirectional light detector 62 may be stopped or continues to spin. If the quasi-omnidirectional light detector 62 is still spinning the processor of the cleaning robot 61 determines the direction of the light beam to calibrate the moving direction of the cleaning robot 61 according to the spin angle of the quasi-omnidirectional light detector 62.

At time T4, the directional light detector 63 fails to detect the light beam output by the light generating device 65 and the cleaning robot 61 stops. Then, the cleaning robot 61 and the quasi-omnidirectional light detector 62 are spun simultaneously. When the directional light detector 63 detects the light beam output by the light generating device 65 again, the cleaning robot 61 and the quasi-omnidirectional light detector 62 are stopped from being spun. At time T5, the cleaning robot 61 movies to the light generating device 65.

In one embodiment, the spin direction of the cleaning robot 61 at time T4 is the same as the spin direction of the cleaning robot 61 at time T2.

At time T6, the directional light detector 63 of the cleaning robot 61 fails to detect the light beam output by the light generating device 65 again. The cleaning robot 61 stops and the cleaning robot 61 and the quasi-omnidirectional light detector 62 are spun simultaneously. When the quasi-omnidirectional light detector 62 detects the light beam output by the light generating device 65, the cleaning robot 61 and the quasi-omnidirectional light detector 62 are stopped from being spun. At time T7, the cleaning robot 61 movies to the light generating device 65.

When the cleaning robot 61 moves to the light generating device 65, the processor of the cleaning robot 61 records the moving paths of the cleaning robot 61 and labels the moving path and a restricted area on a map. In another embodiment, when the processor of the cleaning robot 61 determines the direction of the light beam output by the light generating device, the processor labels the light beam and the restricted area on the map. The map is stored in a memory or a map database of the cleaning robot 61. The processor modifies the map according to the movement of the cleaning robot 61 and labels the positions of obstacles on the map.

When the cleaning robot 61 approaches to the light generating device 65 and the distance between the cleaning robot 61 and the light generating device 65 is less than a predetermined distance, a touch sensor or an acoustic sensor outputs a stop signal to the controller of the cleaning robot 61. The touch sensor or the acoustic sensor is disposed in the front end of the cleaning robot 61 to detect whether there is any obstacle in front of the cleaning robot 61. When the touch sensor or the acoustic sensor detects an obstacle, the cleaning robot 61 first determines whether the obstacle is the light generating device 65. If the obstacle is the light generating device 65, the cleaning robot 61 stops moving and moves in another direction. If the obstacle is not the light generating device 65, the cleaning robot 61 first leaves the original route to avoid the obstacle and returns to the original route after avoiding the obstacle.

When the cleaning robot 61 approaches to the light generating device 65, the light generating device 65 outputs a radio frequency (RF) signal or an infrared signal to let the cleaning robot 61 know that the cleaning robot 61 is close to the light generating device 65. In another embodiment, Near Field Communication (NFC) devices are embedded in both the cleaning robot 61 and the light generating device 65. When the NFC device of the cleaning robot 61 receives signals or data from the NFC device of the light generating device 65, it means that the cleaning robot 61 is close to the light generating device 65 and the cleaning robot 61 should stop accordingly. Generally speaking, the sensing distance of the NFC device is 20 cm.

In FIGS. 4, 5 and 6, the cleaning robot moves toward to the light generating device when detecting the light beam or wireless signal from the light generating device, but the invention is not limited thereto. In another embodiment, the cleaning robot moves away from the virtual when detecting the light beam or wireless signal from the light generating device. Furthermore, the light generating device in FIGS. 4, 5 and 6 can be replaced by a charging station and the cleaning robot can move to the charging station for charging according to the control method in FIG. 4, 5 or 6.

Figure 7B:
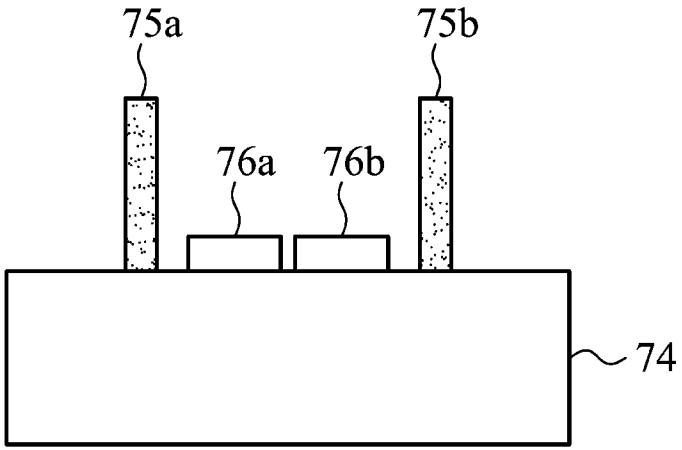
FIG. 7*b* is a schematic diagram of another embodiment of a directional light detector according to the invention.
Figure 7A:
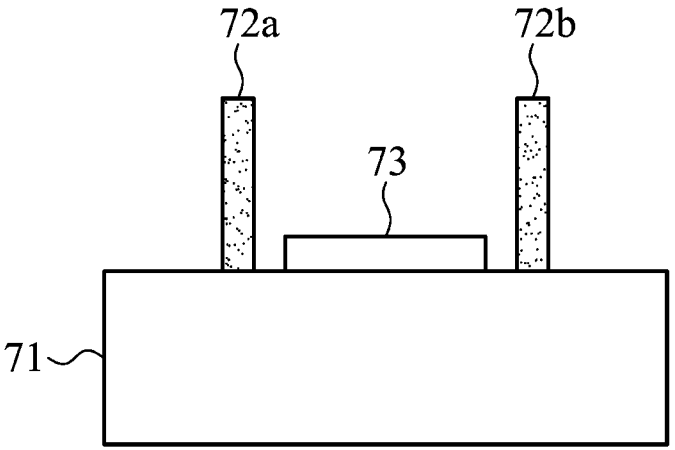
FIG. 7*a* is a schematic diagram of an embodiment of a directional light detector according to the invention.

FIG. 7*a* is a schematic diagram of an embodiment of a directional light detector according to the invention. The directional light detector 71 comprises a light detecting element 73, a first mask 72*a* and a second mask 72*b*. The first mask 72*a* and the second mask 72*b* avoid the light detecting element 73 receiving side light. The first mask 72*a* and the second mask 72*b* are formed by opaque materials. In another embodiment, the first mask 72*a* and the second mask 72*b* can be replaced by an annular mask with a hollow, wherein the light detecting element 73 is disposed in the hollow.

FIG. 7*b* is a schematic diagram of another embodiment of a directional light detector according to the invention. The directional light detector 74 comprises a first light detecting element 76*a*, a second light detecting elements 76*b*, a first mask 75*a* and a second mask 75*b*. The first mask 75*a* and the second mask 75*b* avoid the first light detecting element 76*a* and the second light detecting element 76*b* from receiving side light. The first mask 75*a* and the second mask 75*b* are formed by opaque materials. In another embodiment, the first mask 75*a* and the second mask 75*b* can be replaced by an annular mask with a hollow, wherein the first light detecting element 76*a* and the second light detecting element 76*b* are disposed in the hollow.

When the cleaning robot moves, the directional light detector 74 first detects the light beam from the light generating device and cannot detect the light beam now, the cleaning robot needs to calibration its moving direction. The first light detecting element 76*a* and the second light detect element 76*b* are used for determining whether the cleaning robot is spun in a clockwise direction or counter clockwise direction.

For example, when the directional light detector 74 cannot detect the light beam, the processor of the cleaning robot or a controller of the directional light detector determines whether the first light detecting element 76*a* or the second light detecting element 76*b* is the last light detecting element that detects the light beam from the light generating device. If the first light detecting element 76*a* is the last light detecting element that detects the light beam, the cleaning robot is spun in the counter clockwise direction to calibration the moving direction of the cleaning robot. If the second light detecting element 76*b* is the last light detecting element that detects the light beam, the cleaning robot is spun in the clockwise direction to calibration the moving direction of the cleaning robot.

Figure 7D:
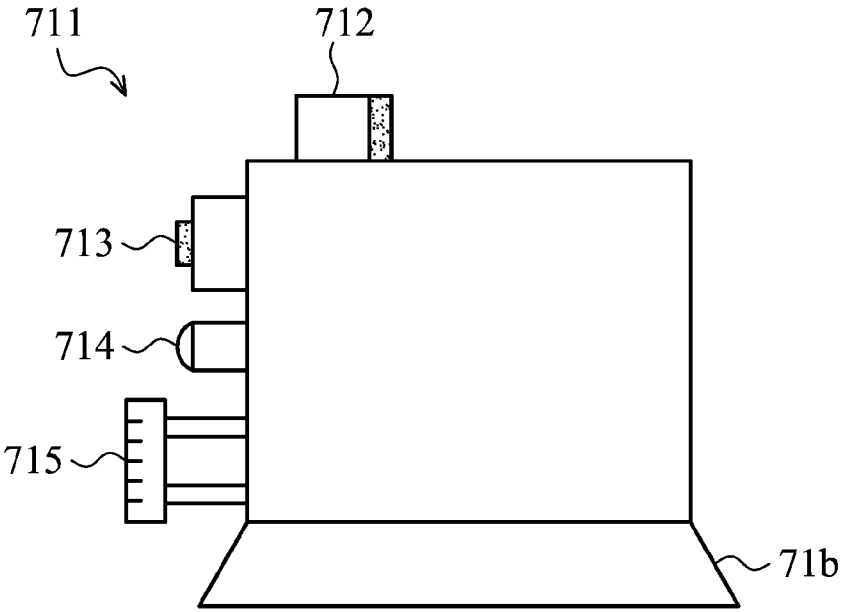
FIG. 7*d* is a schematic diagram of an embodiment of a cleaning robot according to the invention.
Figure 7C:
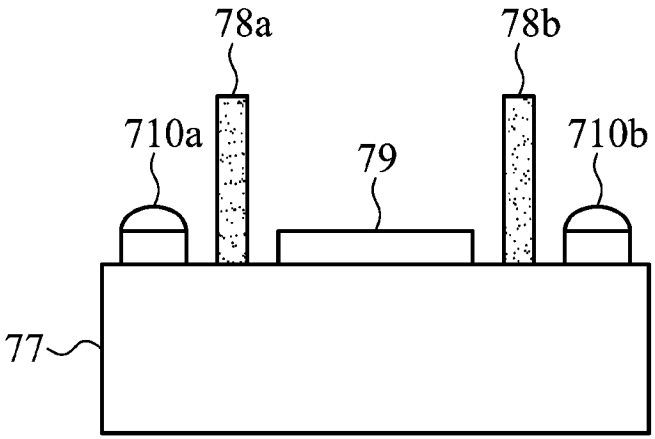
FIG. 7*c* is a schematic diagram of another embodiment of a directional light detector according to the invention.

FIG. 7*c* is a schematic diagram of another embodiment of a directional light detector according to the invention. The directional light detector 74 comprises light detecting element 79, a first transmitter 710*a*, a second transmitter 710*b*, a first mask 78*a* and a second mask 7*bb*. The first mask 78*a* and the second mask 78*b* avoid the light detecting element 79 receiving the side light. The first mask 78*a* and the second mask 78*b* are formed by opaque materials. In another embodiment, the first mask 78*a* and the second mask 78*b* can be replaced by an annular mask with a hollow, wherein the light detecting element 79 is disposed in the hollow.

The first transmitter 710*a* and the second transmitter 710*b* may be a light transmitter or an acoustic signal transmitter. The light generating device comprises a corresponding receiver to receive the output signal from the first transmitter 710*a* and/or the second transmitter 710*b*. When the receiver on the light generating device receives the output signals from the first transmitter 710*a* and/or the second transmitter 710*b*, the light generating device transmits a response signal to the cleaning robot. The response signal is coded or modulated and transmitted to the cleaning robot via the light beam.

It is ensured that the cleaning robot moves to the light generating device straightforwardly according to the first transmitter 710*a* and the second transmitter 710*b*. The cleaning robot can also transmit data to the light generating device via the first transmitter 710*a* and the second transmitter 710*b*, and the light generating device transmits the response data to the cleaning robot via the light beam. Thus, the cleaning robot can communicate with the light generating device during the movement.

FIG. 7*d* is a schematic diagram of an embodiment of a cleaning robot according to the invention. The cleaning robot 711 comprises a quasi-omnidirectional light detector 712, a directional light detector 713, a transmitter 714, a touch sensor 715 and a moving device 716. The moving device moves the cleaning robot 711 according to the detection result of the quasi-omnidirectional light detector 712 and the directional light detector 713. When the quasi-omnidirectional light detector 71 detects a light beam, the quasi-omnidirectional light detector 71 is spun to determine the direction of the light beam. Reference can be made to the descriptions related to FIGS. 2*a*-2*e* for detailed description of the structure of the quasi-omnidirectional light detector 71. Reference can be made to the descriptions related to FIGS. 3-6 for detailed description of the operation and function of the quasi-omnidirectional light detector 71.

The directional light detector 713 is applied to make sure that the cleaning robot 711 moves to the light generating device straightforwardly. Reference can be made to the descriptions related to FIGS. 7*a*-7*c* for detailed description of the structure of the directional light detector 713. Reference can be made to the descriptions related to FIGS. 3-6 for detailed description of the operation and function of the directional light detector 713. The touch sensor may be a mechanical sensor or an acoustic sensor. When the touch sensor 715 detects an obstacle, the touch sensor 715 outputs a sensing signal to the processor of the cleaning robot 711. When the processor of the cleaning robot 711 receives the sensing signal, the processor executes a dodge procedure.

Figure 8:
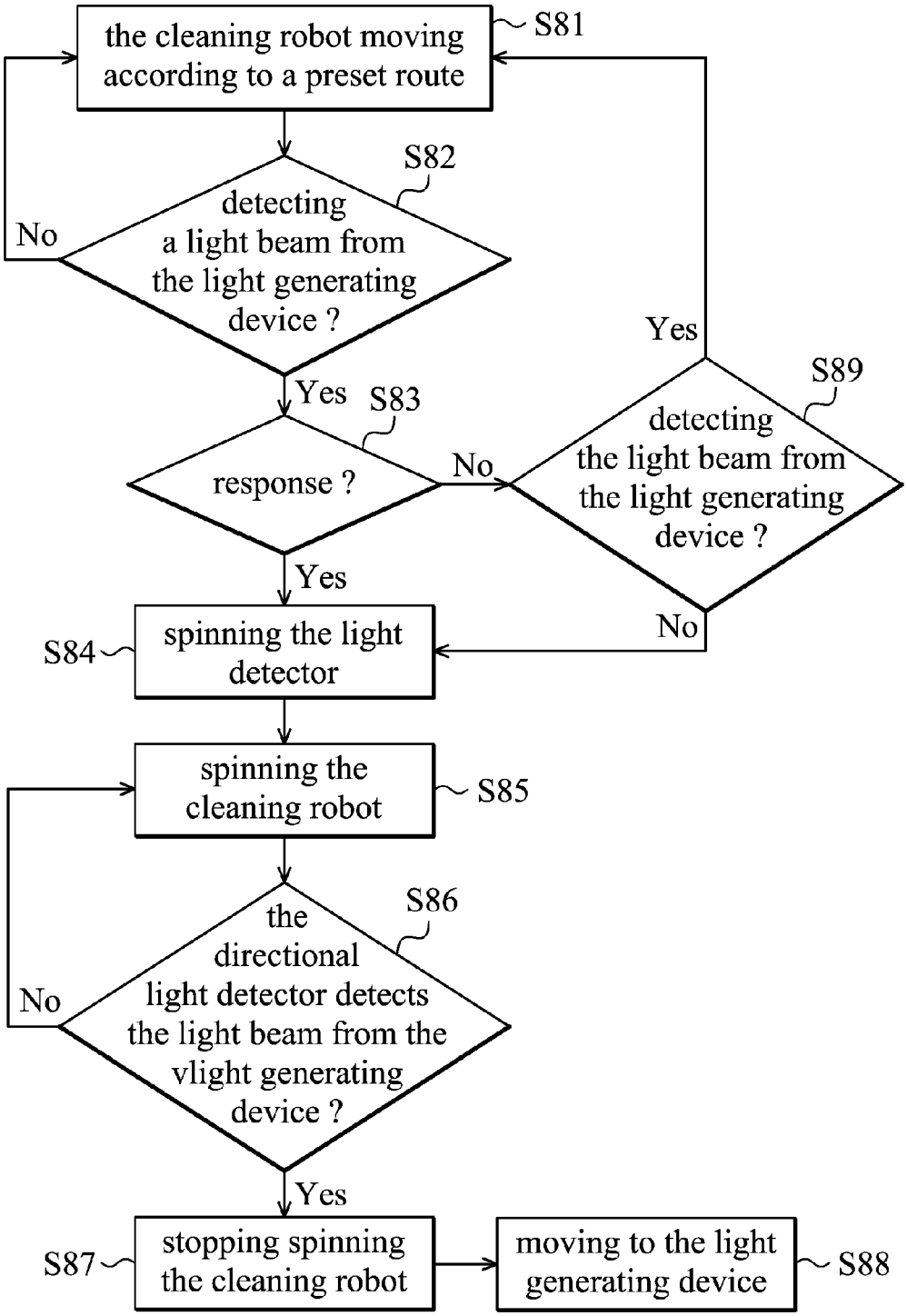
FIG. 8 is a flowchart of a control method of the cleaning robot according to another embodiment of the invention.

FIG. 8 is a flowchart of a control method of the cleaning robot according to another embodiment of the invention. In step S81, the cleaning robot moves according to a preset route. Typically, the cleaning robot moves in a random mode or an initial moving mode set by the user when the cleaning robot starts working. When the cleaning robot moves in the random mode, a controller of the cleaning robot starts drawing an indoor plane map. Next time when the cleaning robot executes a cleaning job, the cleaning robot moves according to the indoor plane map to increase efficiency.

In step S82, a light detector determines whether a light beam from the light generating device is detected. If not, the cleaning robot moves according to the original route. If the light detector detects the light beam from the light generating device, step S83 is then executed. In this embodiment, the light detector is a non-omnidirectional light detector. The light beam emitted by the light generating device carries encoded information or modulated information. When the light detector detects the light beam, the detected beam is decoded or demodulated to confirm whether the light beam is emitted by the light generating device.

In step S83, the controller of the cleaning robot determines whether to respond to the event that the light detector detects by the light beam outputted by the light generating device. For example, the cleaning robot leaves the area covered by the light beam. If the controller decides to respond, step S54 is executed. If the controller decides not to respond, step S59 is executed and the cleaning robot keeps moving.

In step S89, the controller of the cleaning robot continuous to determine whether the light detector of the cleaning robot is still detecting the light beam output by the light generating device. If yes, the cleaning robot keeps moving and the step S89 is still executed. When the light detector of the cleaning robot does not detect the light beam output by the light generating device, step S84 is executed. In the step S89, the situation where the light detector of the cleaning robot does not detect the light beam output by the light generating device represents that the cleaning robot may enter the restricted area and the cleaning robot has to leave as soon as possible.

In the step S83, when the light detector detects the light beam output by the light generating device, the light detector transmits a first trigger signal to the controller and the controller determines to execute the step S84 or step S89 according to the setting of the cleaning robot and the first trigger signal. In one embodiment, the first trigger signal is transmitted to a GPIO (general purpose input/output pin) of the controller and the logic state of the GPIO pin is changed accordingly. For example, assuming the first trigger signal is a rising edge-triggered signal and the default logic state of the GPIO pin is a logic low state, the logic state of the GPIO pin is changed to a logic high state when receiving the rising edge-triggered signal. The change of the logic state of the GPIO pin triggers an interrupt event and the controller of the cleaning robot knows that the light detector has detected the light beam output from the virtual according to the interrupt event.

In step S84, the cleaning robot stops moving and the light detector is spun in a clockwise direction or a counter clockwise direction. Reference can be made to the descriptions related to FIGS. 2*a*-2*e* for detailed description of the structure and the operation of the light detector. When the light detector detects the light beam and then does not, the controller estimates a spin angle of the light detector. Then, the controller determines a spin direction according to the spin angle.

In the step S85, the cleaning robot is spun in the determined direction. In the step S86, the controller determines whether the directional light detector has detected the light beam output by the light generating device. If not, the cleaning robot is continually spun. If yes, step S87 is then executed. In the step S87, the cleaning robot stops spinning.

In the step S88, the cleaning robot moves to the light generating device. During the movement, the cleaning robot stops moving when the light detector fails to detect the light beam from the light generating device. The cleaning robot is then spun in the clockwise direction or the counter clockwise direction to calibrate the moving direction of the cleaning robot.

When the cleaning robot approaches to the light generating device and the distance between the cleaning robot and the light generating device is less than a predetermined distance, a touch sensor outputs a stop signal to the controller of the cleaning robot. The touch sensor is disposed in the front end of the cleaning robot to detect whether there is any obstacle in front of the cleaning robot. When the touch sensor detects an obstacle, the cleaning robot first determines whether the obstacle is the light generating device. If the obstacle is the light generating device, the cleaning robot stops moving and moves in another direction. If the obstacle is not the light generating device, the cleaning robot first leaves the original route to avoid the obstacle and returns to the original route after avoiding the obstacle.

When the cleaning robot approaches to the light generating device, the light generating device outputs a radio frequency (RF) signal or an infrared signal to let the cleaning robot 32 know that the cleaning robot is near to the light generating device. In another embodiment, Near Field Communication (NFC) devices are embedded in both the cleaning robot and the light generating device. When the NFC device of the cleaning robot receives signals or data from the NFC device of the light generating device, it means that the cleaning robot is very close to the light generating device and the cleaning robot should stop accordingly. Generally speaking, the sensing distance of the NFC device is 20 cm.

Figure 9:
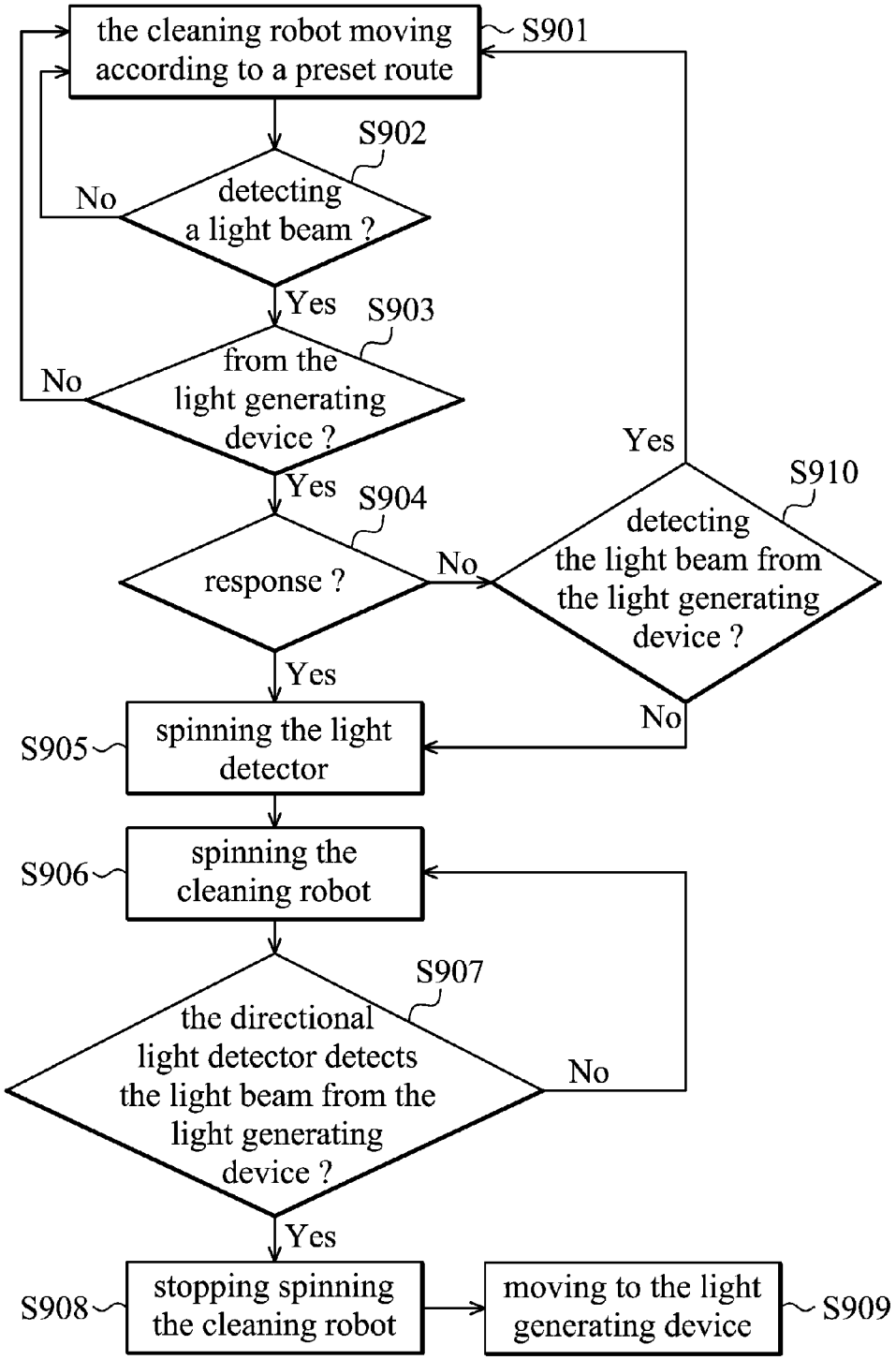
FIG. 9 is a flowchart of a control method of the cleaning robot according to another embodiment of the invention.

FIG. 9 is a flowchart of a control method of the cleaning robot according to another embodiment of the invention. In step S901, the cleaning robot moves according to a preset route. In the step S902, a controller of the cleaning robot determines whether the light detector has detected a light beam. If not, the cleaning robot continually moves according to the preset route. If yes, the step S903 is executed to determine whether the light beam was output by the light generating device. Since the light beam output by the light generating device carries encoded data or modulated data, the controller of the cleaning robot or the light detector decodes or demodulates the received light beam to determine whether the light beam was output by the light generating device. In this embodiment, the light detector is a quasi-omnidirectional light detector.

In step S904, the controller of the cleaning robot determines whether to respond to the event that the light detector detects the light beam outputted by the light generating device. For example, the cleaning robot leaves the area covered by the light beam. If the controller decides to respond, step S902 is executed. If the controller decides not to respond, step S910 is executed and the cleaning robot keeps moving.

In step S910, the controller of the cleaning robot continuous to determine whether the light detector of the cleaning robot is still detecting the light beam output by the light generating device. If yes, the cleaning robot keeps moving and the step S910 is still executed. When the light detector of the cleaning robot does not detect the light beam output by the light generating device, step S905 is executed. In the step S905, the situation where the light detector of the cleaning robot does not detect the light beam output by the light generating device represents that the cleaning robot may enter the restricted area and the cleaning robot has to leave as soon as possible.

In the step S903, when the light detector detects the light beam output by the light generating device, the light detector transmits a first trigger signal to the controller and the controller determines to execute the step S904 or step S910 according to the setting of the cleaning robot and the first trigger signal. In one embodiment, the first trigger signal is transmitted to a GPIO (general purpose input/output pin) of the controller and the logic state of the GPIO pin is changed accordingly. For example, assuming the first trigger signal is a rising edge-triggered signal and the default logic state of the GPIO pin is a logic low state, the logic state of the GPIO pin is changed to a logic high state when receiving the rising edge-triggered signal. The change of the logic state of the GPIO pin triggers an interrupt event and the controller of the cleaning robot knows that the light detector has detected the light beam output from the virtual according to the interrupt event.

In step S905, the cleaning robot stops moving and the light detector is spun in a clockwise direction or a counter clockwise direction. Reference can be made to the descriptions related to FIGS. 2*a*-2*e* for detailed description of the structure and the operation of the light detector. When the light detector detects the light beam and then does not, the controller estimates a spin angle of the light detector. Then, the controller determines a spin direction according to the spin angle.

In the step S906, the cleaning robot is spun in the determined direction. In the step S907, the controller determines whether the directional light detector has detected the light beam output by the light generating device. If not, the cleaning robot is continually spun. If yes, step S908 is then executed. In the step S908, the cleaning robot stops spinning.

In the step S909, the cleaning robot moves to the light generating device. During the movement, the cleaning robot stops moving when the light detector fails to detect the light beam from the light generating device. The cleaning robot is then spun in the clockwise direction or the counter clockwise direction to calibrate the moving direction of the cleaning robot.

When the cleaning robot approaches to the light generating device and the distance between the cleaning robot and the light generating device is less than a predetermined distance, a touch sensor outputs a stop signal to the controller of the cleaning robot. The touch sensor is disposed in the front end of the cleaning robot to detect whether there is any obstacle in front of the cleaning robot. When the touch sensor detects an obstacle, the cleaning robot first determines whether the obstacle is the light generating device. If the obstacle is the light generating device, the cleaning robot stops moving and moves in another direction. If the obstacle is not the light generating device, the cleaning robot first leaves the original route to avoid the obstacle and returns to the original route after avoiding the obstacle.

When the cleaning robot approaches to the light generating device, the light generating device outputs a radio frequency (RF) signal or an infrared signal to let the cleaning robot 32 know that the cleaning robot is near to the light generating device. In another embodiment, Near Field Communication (NFC) devices are embedded in both the cleaning robot and the light generating device. When the NFC device of the cleaning robot receives signals or data from the NFC device of the light generating device, it means that the cleaning robot is very close to the light generating device and the cleaning robot should stop accordingly. Generally speaking, the sensing distance of the NFC device is 20 cm.

Figure 10:
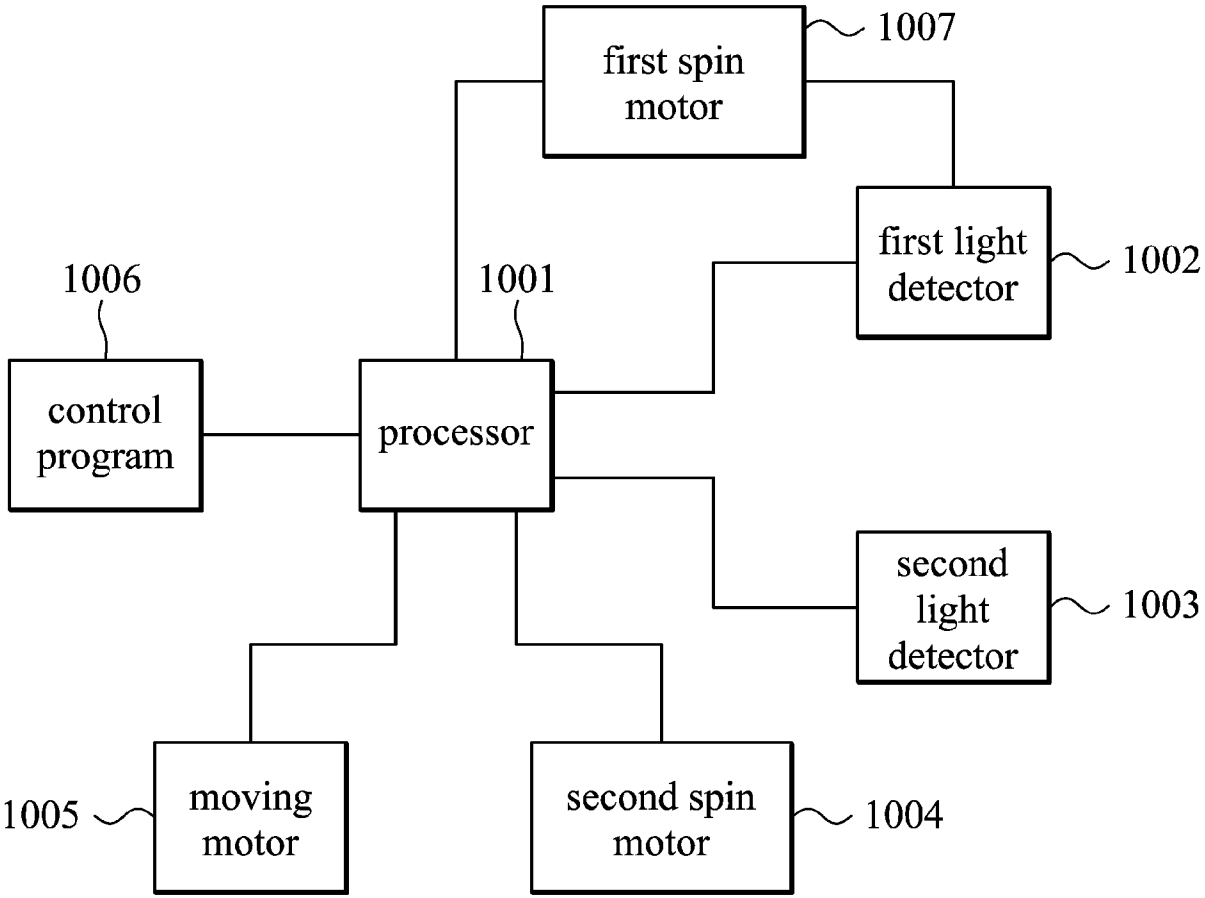
FIG. 10 is a functional block diagram of another embodiment of a cleaning robot according to the invention.

FIG. 10 is a functional block diagram of another embodiment of a cleaning robot according to the invention. The processor 1001 executes the control program 1006 to control the cleaning robot. The cleaning robot comprises a first light detector 1002 and a second light detector 1003. The first light detector 1002 is a quasi-omnidirectional light detector and can be spun by the first spin motor 1007. When the first light detector 1002 detects a light beam from a light generating device, the processor 1001 controls the first spin motor 1007 to spin the first light detector 1002. When the first light detector 1002 does not detect the light beam from the light generating device, the first light detector 1002 is stopped from being spun and the processor 1001 determines a spin direction of the cleaning robot according to a spin angle of the first light detector 1002.

The processor controls a second spin motor 1004 to spin the cleaning robot according to the determined direction. When the second light detector 1003 detects the light beam from the light generating device, the cleaning robot is stopped from being spun. The processor 1001 then controls the moving motor 1005 and the cleaning robot moves to the light generating device straightforwardly. The moving motor 1005 only moves the cleaning robot forward or backward.

Figure 11:
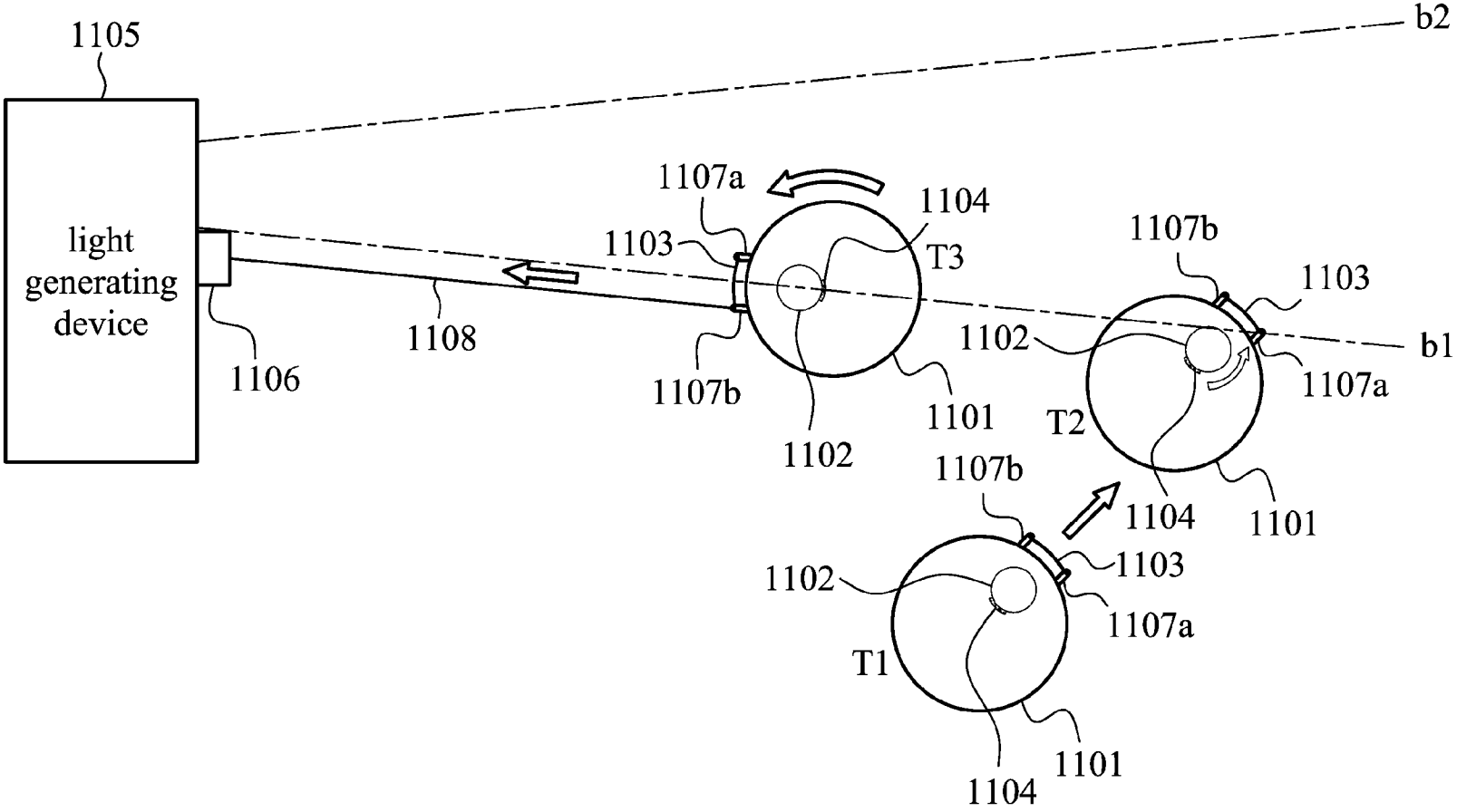
FIG. 11 is a schematic diagram of a control method for a cleaning robot according to another embodiment of the invention.

FIG. 11 is a schematic diagram of a control method for a cleaning robot according to another embodiment of the invention. The light generating device 1105 outputs a light beam to label a restricted area that the cleaning robot 1101 should not enter. In other embodiments, the light generating device 1105 is named as light house or light tower and outputs the light beam or other wireless signals. The light beam comprises a first boundary b1 and a second boundary b2. At time T1, the cleaning robot 1101 moves along a predetermined route. At time T2, the quasi-omnidirectional light detector 1102 detects the first boundary b2 of a light beam emitted by the light generating device 1105. The cleaning robot 1101 stops moving, and the quasi-omnidirectional light detector 1102 is spun in a counter clockwise direction or a clockwise direction.

When the mask 1104 blocks the light beam emitted from the light generating device 1105 and the quasi-omnidirectional light detector 1102 cannot detect the light beam, a controller of the cleaning robot 1101 records a current position of the mask 1104 and estimates a first spin angle of the quasi-omnidirectional light detector 1102 according to an initial position of the mask 1104 and the current position of the mask 1104 to determine a spin direction of the cleaning robot 1101.

For example, assuming the first spin angle is less than 180 degrees, the cleaning robot 1101 is spun in the clockwise direction. The cleaning robot 1101 is spun in the counter clockwise direction when the first spin angle is larger than 180 degrees.

At time T3, the cleaning robot 1101 is spun according to the determined direction until the directional light detector 1103 detects the light beam output by the light generating device 1105. When the directional light detector 1103 detects the light beam output by the light generating device 1105, the cleaning robot 1101 stops spinning. Generally speaking, when the directional light detector detects the light beam output by the light generating device 1105, the light detection units detecting the light beam are located at the margin of the directional light detector 1103. Thus, when the cleaning robot 1101 moves again, the directional light detector 1103 may fail to detect the light beam quickly and the cleaning robot 1101 has to stop again to calibrate the moving direction.

To solve the aforementioned issue, in one embodiment, the processor of the cleaning robot 1101 estimates a delay time according to the angular velocity of the cleaning robot 1101 and the size of the directional light detector 1103. When the directional light detector 1103 detects the light beam, the cleaning robot 1101 stops spinning after the delay time. By the delay time, the light beam output by the light generating device 1105 can be detected by the center of the directional light detector 1103.

It is noted that the cleaning robot 1101 stays at the same position at times T2 and T3. At time T2, the cleaning robot 1101 is not moved or spun and only the quasi-omnidirectional light detector 1102 is spun. At time T3, the cleaning robot 1101 is spun in a circle at the original position. Although the position of the cleaning robot 1101 at time T2 is different from the position of the cleaning robot 1101 at time T3 in FIG. 11, it represents only two operations at the same position but at different times. In fact, the position of the cleaning robot 1101 does not change at time T2 and T3.

Furthermore, at time T3, a first transmitter 1107*a* and/or a second transmitter 1107*b* outputs a signal 1108 to a receiver 1106 of the light generating device 1105. The first transmitter 1107*a* and the second transmitter 1107*b* may be light signal transmitters or acoustic signal transmitters. The signal 1108 may be a light signal or an acoustic signal. When the receiver 1106 receives the signal from the first transmitter 1107*a* and/or the second transmitter 1107*b*, it means that the cleaning robot 1101 is opposite to the light generating device 1105. The light generating device 1005 transmits a confirm data to the directional light detector 1103 or the quasi-omnidirectional light detector 1102 via its output light beam to inform the controller of the cleaning robot 1101 that the moving direction of the cleaning 1101 is correct.

In another embodiment, the operations of the cleaning robot 1101 at time T2 and T3 can be integrated in one step. At time T2, the quasi-omnidirectional light detector 1102 is spun in a predetermined direction, and the cleaning robot is also spun in the predetermined direction. When the directional light detector 1103 detects the light beam output by the light generating device 1105, the cleaning robot 1101 stops spinning. When the cleaning robot 1101 stops spinning, the quasi-omnidirectional light detector 1102 may be stopped or continues to spin. If the quasi-omnidirectional light detector 1102 is still spinning the processor of the cleaning robot 1101 determines the direction of the light beam to calibrate the moving direction of the cleaning robot 1101 according to the spin angle of the quasi-omnidirectional light detector 1102. In another embodiment, when the direction light detector 1103 detects the light beam output by the virtual 1105, the quasi-omnidirectional light detector 1102 is still spun and the cleaning robot 1101 is stopped from being spun. The processor of the cleaning robot 1101 acquires a spin angle of the quasi-omnidirectional light detector 1102 after the cleaning robot 1101 is stopped from being spun. The processor then estimates a spin angle of the cleaning robot 1101 according to the acquired spin angle to calibrate the moving direction of the cleaning robot 1101.

When the cleaning robot 1101 moves to the light generating device 1105, the processor of the cleaning robot 1101 records the moving paths of the cleaning robot 1101 and labels the moving path and a restricted area on a map. In another embodiment, when the processor of the cleaning robot 1101 determines the direction of the light beam output by the light generating device 1105, the processor labels the light beam and the restricted area on the map. The map is stored in a memory or a map database of the cleaning robot 1101. The processor modifies the map according to the movement of the cleaning robot 1101 and labels the positions of obstacles on the map.

When the cleaning robot 1101 approaches to the light generating device 1105 and the distance between the cleaning robot 1101 and the light generating device 1105 is less than a predetermined distance, a touch sensor or an acoustic sensor outputs a stop signal to the controller of the cleaning robot 1101. The touch sensor or the acoustic sensor is disposed in the front end of the cleaning robot 1101 to detect whether there is any obstacle in front of the cleaning robot 1101. When the touch sensor or the acoustic sensor detects an obstacle, the cleaning robot 1101 first determines whether the obstacle is the light generating device 1105. If the obstacle is the light generating device 1105, the cleaning robot 1101 stops moving and moves in another direction. If the obstacle is not the light generating device 1105, the cleaning robot 1101 first leaves the original route to avoid the obstacle and returns to the original route after avoiding the obstacle.

When the cleaning robot 1101 approaches to the light generating device 1105, the light generating device 1105 outputs a radio frequency (RF) signal or an infrared signal to let the cleaning robot 1101 know that the cleaning robot 1101 is close to the light generating device 1105. In another embodiment, Near Field Communication (NFC) devices are embedded in both the cleaning robot 1101 and the light generating device 1105. When the NFC device of the cleaning robot 41 receives signals or data from the NFC device of the light generating device 1105, it means that the cleaning robot 1101 is close to the light generating device 1105 and the cleaning robot 1101 should stop accordingly. Generally speaking, the sensing distance of the NFC device is 20 cm.

According to the above description, the cleaning robot 1101 can clean the areas near the light beam output by the light generating device 1105 and the cleaning robot 1101 will not enter a restricted area. Furthermore, the controller of the cleaning robot 1101 can draw a map of the cleaning area. When the cleaning robot 1101 cleans the same area again, the cleaning robot 1101 can move according to the map of the cleaning area to complete the cleaning job efficiently and quickly.

Figure 12:
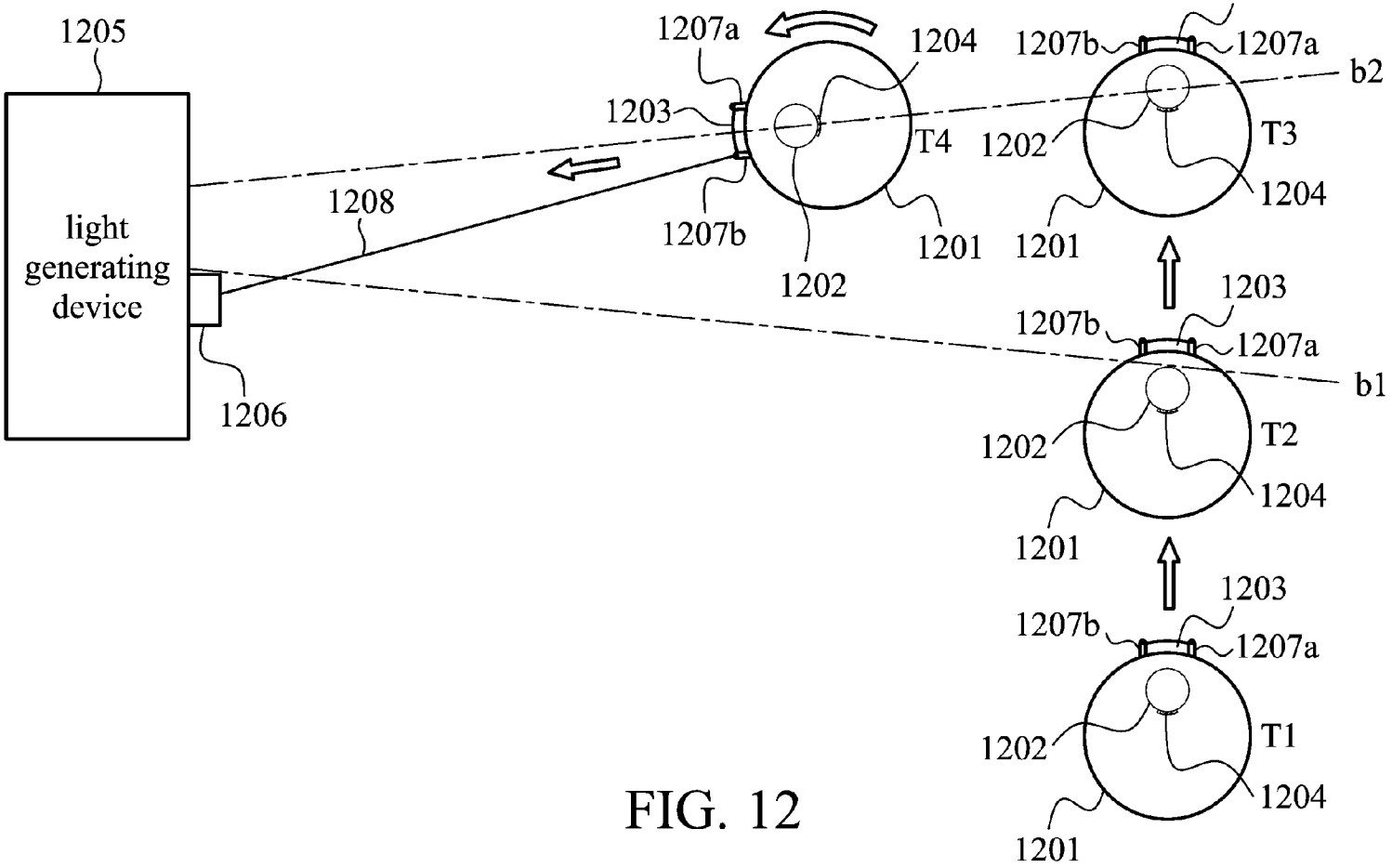
FIG. 12 is a schematic diagram of a control method for a cleaning robot according to another embodiment of the invention.

FIG. 12 is a schematic diagram of a control method for a cleaning robot according to another embodiment of the invention. The light generating device 1205 outputs a light beam to label a restricted area that the cleaning robot 1201 should not enter. In other embodiments, the light generating device 1205 is named as light house or light tower and outputs the light beam or other wireless signals. The light beam comprises a first boundary b1 and a second boundary b2. At time T1, the cleaning robot 1201 moves along a predetermined route. At time T2, the quasi-omnidirectional light detector 1202 detects the first boundary b2 of a light beam emitted by the light generating device 1205. The cleaning robot 120 continually moves according to the preset route. At time T3, the quasi-omnidirectional light detector 1202 does not detect the light beam from the virtual 1205, and the cleaning robot 1201 stops moving. Then, the quasi-omnidirectional light detector 1202 is spun in a counter clockwise direction or a clockwise direction.

When the mask 1204 blocks the light beam emitted from the light generating device 1205, the quasi-omnidirectional light detector 1202 cannot detect the light beam. A controller of the cleaning robot 1201 records a current position of the mask 1204 and estimates a first spin angle of the quasi-omnidirectional light detector 1202 according to an initial position of the mask 1204 and the current position of the mask 1204 to determine a spin direction of the cleaning robot 1201.

For example, assuming the first spin angle is less than 180 degrees, the cleaning robot 1201 is spun in the clockwise direction. The cleaning robot 1201 is spun in the counter clockwise direction when the first spin angle is larger than 180 degrees.

At time T4, the cleaning robot 1201 is spun according to the determined direction until the directional light detector 1203 detects the light beam output by the light generating device 1205. When the directional light detector 1203 detects the light beam output by the light generating device 1205, the cleaning robot 1201 stops spinning. Generally speaking, when the directional light detector detects the light beam output by the light generating device 1205, the light detection units detecting the light beam are located at the margin of the directional light detector 1203. Thus, when the cleaning robot 1201 moves again, the directional light detector 1203 may fail to detect the light beam quickly and the cleaning robot 1201 has to stop again to calibrate the moving direction.

To solve the aforementioned issue, in one embodiment, the processor of the cleaning robot 1201 estimates a delay time according to the angular velocity of the cleaning robot 1201 and the size of the directional light detector 1203. When the directional light detector 1203 detects the light beam, the cleaning robot 1201 stops spinning after the delay time. By the delay time, the light beam output by the light generating device 1205 can be detected by the center of the directional light detector 1203.

It is noted that the cleaning robot 1201 stays at the same position at times T3 and T4. At time T3, the cleaning robot 1201 is not moved or spun and only the quasi-omnidirectional light detector 1202 is spun. At time T4, the cleaning robot 1201 is spun in a circle at the original position. Although the position of the cleaning robot 1201 at time T3 is different from the position of the cleaning robot 1201 at time T4 in FIG. 12, it represents only two operations at the same position but at different times. In fact, the position of the cleaning robot 1201 does not change at time T3 and T4.

Furthermore, at time T4, a first transmitter 1207*a* and/or a second transmitter 1207*b* outputs a signal 1208 to a receiver 1206 of the light generating device 1205. The first transmitter 1207*a* and the second transmitter 1207*b* may be light signal transmitters or acoustic signal transmitters. The signal 1208 may be a light signal or an acoustic signal. When the receiver 1206 receives the signal from the first transmitter 1207*a* and/or the second transmitter 1207*b*, it means that the cleaning robot 1201 is opposite to the light generating device 1205. The light generating device 1005 transmits a confirm data to the directional light detector 1203 or the quasi-omnidirectional light detector 1202 via its output light beam to inform the controller of the cleaning robot 1201 that the moving direction of the cleaning 1201 is correct.

In another embodiment, the operations of the cleaning robot 1201 at time T3 and T4 can be integrated in one step. At time T3, the quasi-omnidirectional light detector 1202 is spun in a predetermined direction, and the cleaning robot is also spun in the predetermined direction. When the directional light detector 1203 detects the light beam output by the light generating device 1205, the cleaning robot 1201 stops spinning. When the cleaning robot 1201 stops spinning, the quasi-omnidirectional light detector 1202 may be stopped or continues to spin. If the quasi-omnidirectional light detector 1202 is still spinning the processor of the cleaning robot 1201 determines the direction of the light beam to calibrate the moving direction of the cleaning robot 1201 according to the spin angle of the quasi-omnidirectional light detector 1202. In another embodiment, when the direction light detector 1203 detects the light beam output by the virtual 1205, the quasi-omnidirectional light detector 1202 is still spun and the cleaning robot 1201 is stopped from being spun. The processor of the cleaning robot 1201 acquires a spin angle of the quasi-omnidirectional light detector 1202 after the cleaning robot 1201 is stopped from being spun. The processor then estimates a spin angle of the cleaning robot 1201 according to the acquired spin angle to calibrate the moving direction of the cleaning robot 1201.

When the cleaning robot 1201 moves to the light generating device 1205, the processor of the cleaning robot 1201 records the moving paths of the cleaning robot 1201 and labels the moving path and a restricted area on a map. In another embodiment, when the processor of the cleaning robot 1201 determines the direction of the light beam output by the light generating device 1205, the processor labels the light beam and the restricted area on the map. The map is stored in a memory or a map database of the cleaning robot 1201. The processor modifies the map according to the movement of the cleaning robot 1201 and labels the positions of obstacles on the map.

When the cleaning robot 1201 approaches to the light generating device 1205 and the distance between the cleaning robot 1201 and the light generating device 1205 is less than a predetermined distance, a touch sensor or an acoustic sensor outputs a stop signal to the controller of the cleaning robot 1201. The touch sensor or the acoustic sensor is disposed in the front end of the cleaning robot 1201 to detect whether there is any obstacle in front of the cleaning robot 1201. When the touch sensor or the acoustic sensor detects an obstacle, the cleaning robot 1201 first determines whether the obstacle is the light generating device 1205. If the obstacle is the light generating device 1205, the cleaning robot 1201 stops moving and moves in another direction. If the obstacle is not the light generating device 1205, the cleaning robot 1201 first leaves the original route to avoid the obstacle and returns to the original route after avoiding the obstacle.

When the cleaning robot 1201 approaches to the light generating device 1205, the light generating device 1205 outputs a radio frequency (RF) signal or an infrared signal to let the cleaning robot 1201 know that the cleaning robot 1201 is close to the light generating device 1205. In another embodiment, Near Field Communication (NFC) devices are embedded in both the cleaning robot 1201 and the light generating device 1205. When the NFC device of the cleaning robot 41 receives signals or data from the NFC device of the light generating device 1205, it means that the cleaning robot 1201 is close to the light generating device 1205 and the cleaning robot 1201 should stop accordingly. Generally speaking, the sensing distance of the NFC device is 20 cm.

According to the above description, the cleaning robot 1201 can clean the areas near the light beam output by the light generating device 1205 and the cleaning robot 1201 will not enter a restricted area. Furthermore, the controller of the cleaning robot 1201 can draw a map of the cleaning area. When the cleaning robot 1201 cleans the same area again, the cleaning robot 1201 can move according to the map of the cleaning area to complete the cleaning job efficiently and quickly.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A control method of a cleaning robot with a quasi-omnidirectional light detector and a directional light detector, comprising:

spinning the quasi-omnidirectional light detector when the quasi-omnidirectional light detector detects a light beam;

stopping the spinning of the quasi-omnidirectional light detector and estimating a spin angle when the quasi-omnidirectional does not detect the light beam;

determining a spin direction according to the spin angle;

spinning the cleaning robot according to the spin direction; and stopping the spinning of the cleaning robot when the directional light detector detects the light beam.

2. The method as claimed in claim 1, further comprising: determining whether the light beam was output by a light generating device when detecting the light beam.

3. The method as claimed in claim 1, wherein when the spin angle is less than 180 degrees, the spin direction is a counter clockwise direction, and when the spin angle is larger than 180 degrees, the spin direction is a clockwise direction.

4. The method as claimed in claim 1, further comprising: fixing a mask of the quasi-omnidirectional light detector disposed in a backside of the quasi-omnidirectional light detector when the directional light detector detects the light beam.

5. The method as claimed in claim 1, further comprising: moving the cleaning robot to a light generating device along the light beam.

6. The method as claimed in claim 5, wherein when the cleaning robot moves to the light generating device along the light beam and the directional light detector cannot detect the light beam, the cleaning robot is spun in a predetermined direction and stops spinning when the directional light detector detects the light beam.

7. The method as claimed in claim 5, further comprising: stopping the cleaning robot when the directional light detector cannot detect the light beam during the movement to the light generating device; spinning the quasi-omnidirectional light detector to determine a first spin direction; spinning the cleaning robot according to the first spin direction; and stopping the spinning of the cleaning robot when the directional light detector detects the light beam and moving the cleaning robot straightforwardly.

8. The method as claimed in claim 1, wherein the quasi-omnidirectional light detector comprises a light detector and a rib and the light detector cannot detect or transmit signal in a specific direction because of the rib.

9. A control method of a cleaning robot with a quasi-omnidirectional light detector and a directional light detector, comprising:

detecting a light beam via the quasi-omnidirectional light detector;

continuing the movement of the cleaning robot when the quasi-omnidirectional light detector detects a light beam for a first time;

stopping the spinning of the quasi-omnidirectional light detector and estimating a spin angle when the quasi-omnidirectional light detector does not detect the light beam;

determining a spin direction according to the spin angle;

spinning the cleaning robot according to the spin direction; and stopping the spinning of the cleaning robot when the directional light detector detects the light beam.

10. The method as claimed in claim 9, further comprising: determining whether the light beam was output by a light generating device when detecting the light beam.

11. The method as claimed in claim 9, wherein when the spin angle is less than 180 degrees, the spin direction is a counter clockwise direction, and when the spin angle is larger than 180 degrees, the spin direction is a clockwise direction.

12. The method as claimed in claim 11, further comprising: fixing a mask of the quasi-omnidirectional light detector disposed in a backside of the quasi-omnidirectional light detector when the directional light detector detects the light beam.

13. The method as claimed in claim 9, further comprising: moving the cleaning robot to a light generating device along the light beam.

14. The method as claimed in claim 13, wherein when the cleaning robot moves to the light generating device along the light beam and the directional light detector cannot detect the light beam, the cleaning robot is spun in a predetermined direction and stops spinning when the directional light detector detects the light beam.

15. The method as claimed in claim 13, further comprising: stopping the cleaning robot when the directional light detector cannot detect the light beam during the movement to the light generating device; spinning the quasi-omnidirectional light detector to determine a first spin direction; spinning the cleaning robot according to the first spin direction; and stopping the spinning of the cleaning robot when the directional light detector detects the light beam and moving the cleaning robot straightforwardly.

16. A cleaning robot comprising:

a non-omni directional light detector to detect a wireless signal; and a directional light detector to detect the wireless signal, wherein when the non-omni directional light detector detects the wireless signal, a spin direction is determined via the non-omni directional light detector, and the cleaning robot is spun according to the spin direction and the cleaning robot stops spinning when the directional light detector detects the wireless signal.

17. The cleaning robot as claimed in claim 16, further comprising: a controller to receive a first detection result of the non-omni directional light detector and a second detection result of the directional light detector; a first spin motor, controlled by the controller, to spin the non-omni directional light detector; and a second spin motor, controlled by the controller to spin the cleaning robot.

18. The cleaning robot as claimed in claim 17, further comprising a moving motor, controlled by the controller, to move the cleaning robot forwardly or backwardly.

* * * * *